US008316570B2

(12) United States Patent
Potterfield et al.

(10) Patent No.: US 8,316,570 B2
(45) **Date of Patent: *Nov. 27, 2012**

(54) BIPOD DEVICE FOR USE WITH A FIREARM

(75) Inventors: Russell A. Potterfield, Columbia, MO (US); Tim Morrow, Jefferson City, MO (US); Yan-Jiang Zhou, Columbia, MO (US); Tim Kinney, Columbia, MO (US); Dennis Cauley, Boonville, MO (US); David Yale, Santa Clara, CA (US); Robert Joseph Zara, Rocheport, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/848,649

(22) Filed: Aug. 2, 2010

(65) Prior Publication Data

US 2011/0214330 A1 Sep. 8, 2011

Related U.S. Application Data

(63) Continuation of application No. 11/801,341, filed on May 8, 2007, now Pat. No. 7,779,572.

(60) Provisional application No. 60/798,700, filed on May 8, 2006, provisional application No. 60/798,873, filed on May 9, 2006.

(51) Int. Cl.
*F41A 23/08* (2006.01)

(52) U.S. Cl. ..... 42/94

(58) Field of Classification Search ..... 42/94
See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |

(Continued)

FOREIGN PATENT DOCUMENTS

DE 838872 C 5/1952

(Continued)

OTHER PUBLICATIONS

U.S. Appl. No. 11/505,784, filed Aug. 16, 2006, Cauley.

(Continued)

*Primary Examiner* — Michael Carone
*Assistant Examiner* — Reginald Tillman, Jr.
(74) *Attorney, Agent, or Firm* — Perkins Coie LLP

(57) ABSTRACT

Bipods and mounting devices for attaching to and supporting firearms, more specifically, bipods which allow independent tension-adjustable movement around two axes. For example, the bipod assembly can be tension-adjusted with a first cam lock for cant movement and can be tension-adjusted with a second cam lock for pivotal movement. Accordingly, independently tension-adjustable and lockable pivot and cam adjustments are provided by this bipod assembly.

18 Claims, 31 Drawing Sheets

U.S. PATENT DOCUMENTS

| | | | |
|---|---|---|---|
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |
| 1,195,777 | A | 8/1916 | Burtin |
| 1,250,215 | A | 12/1917 | Panes |
| 1,256,255 | A | 2/1918 | Porter |
| 1,295,688 | A | 2/1919 | Butler |
| 1,367,353 | A | 2/1921 | Craig |
| 1,488,647 | A | 4/1924 | Quinn |
| 1,491,604 | A | 4/1924 | Fuller |
| 1,639,722 | A | 8/1927 | Whitney |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |
| 1,927,876 | A | 9/1933 | Meyer |
| 1,928,871 | A | 10/1933 | Swebilius |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,378,545 | A | 6/1945 | Fraser et al. |
| D147,305 | S | 8/1947 | Sloan |
| 2,432,519 | A | 12/1947 | Garand |
| 2,451,266 | A | 10/1948 | Whittemore |
| 2,455,644 | A | 12/1948 | Barnes |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,638,676 | A | 5/1953 | Callahan |
| 2,677,207 | A | 5/1954 | Stewart |
| 2,701,930 | A | 2/1955 | Dolan |
| 2,731,829 | A | 1/1956 | Wigington et al. |
| 2,740,530 | A | 4/1956 | Ponder |
| 2,753,642 | A | 7/1956 | Sullivan |
| 2,774,090 | A | 12/1956 | Allinson |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 2,847,909 | A | 8/1958 | Kester |
| 2,867,931 | A | 1/1959 | Schreiber |
| 2,877,689 | A | 3/1959 | Pribis |
| 2,894,347 | A | 7/1959 | Woodcock |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,013,289 | A | 12/1961 | Sasena |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,107,642 | A | 10/1963 | Lakin |
| 3,112,567 | A | 12/1963 | Flanagan |
| 3,125,929 | A | 3/1964 | Peasley |
| 3,128,668 | A | 4/1964 | Dicken |
| 3,137,957 | A | 6/1964 | Ingalls |
| 3,163,420 | A | 12/1964 | Braun |
| 3,175,456 | A | 3/1965 | Goodsell |
| 3,183,617 | A | 5/1965 | Ruger et al. |
| 3,205,518 | A | 9/1965 | Romaine |
| 3,206,885 | A | 9/1965 | Dye |
| 3,225,656 | A | 12/1965 | Flaherty et al. |
| D203,680 | S | 2/1966 | Benchrest |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr. |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,536,160 | A | 10/1970 | Brewer |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,646,704 | A | 3/1972 | Ellsworth |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,736,243 | A | 5/1973 | Duggan |
| 3,738,101 | A | 6/1973 | Simon-Vermot |
| 3,739,515 | A | 6/1973 | Koon, Jr. |
| 3,743,088 | A | 7/1973 | Henkin |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,771,176 | A | 11/1973 | Herman, Sr. |
| 3,804,238 | A | 4/1974 | Howard |
| 3,813,816 | A | 6/1974 | Funk |
| 3,815,270 | A | 6/1974 | Pachmayr |
| 3,826,559 | A | 7/1974 | Berliner et al. |
| 3,827,172 | A | 8/1974 | Howe |
| 3,842,527 | A | 10/1974 | Low |
| D233,853 | S | 12/1974 | Ferrara |
| 3,877,178 | A | 4/1975 | Campanelli |
| 3,878,939 | A | 4/1975 | Wilcox |
| 3,885,357 | A | 5/1975 | Hoyt |
| 3,889,797 | A | 6/1975 | Naito et al. |
| 3,893,266 | A | 7/1975 | Anderson et al. |
| 3,895,803 | A | 7/1975 | Loe |
| 3,899,175 | A | 8/1975 | Loe |
| D237,106 | S | 10/1975 | Baljet et al. |
| 3,913,746 | A | 10/1975 | Burton |
| 3,914,879 | A | 10/1975 | Taylor, III et al. |
| 3,935,657 | A | 2/1976 | Wade |
| 3,947,988 | A | 4/1976 | Besaw |
| 3,949,987 | A | 4/1976 | Candor |
| 3,961,436 | A | 6/1976 | Hagen et al. |
| 3,964,613 | A | 6/1976 | Anderson, Jr. |
| 3,979,849 | A | 9/1976 | Haskins |
| 4,007,554 | A | 2/1977 | Helmstadter |
| 4,012,860 | A | 3/1977 | Auger |
| 4,021,971 | A | 5/1977 | McFadden |
| 4,026,057 | A | 5/1977 | Cady |
| 4,027,781 | A | 6/1977 | Covert |
| 4,042,242 | A | 8/1977 | Nicholls et al. |

4,054,288 A 10/1977 Perrine, Sr.
4,055,016 A 10/1977 Katsenes
4,072,313 A 2/1978 Murso et al.
4,076,247 A 2/1978 Kim et al.
4,090,606 A 5/1978 Dawson
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,222,305 A 9/1980 Lee
4,223,588 A 9/1980 Simpson
4,233,748 A 11/1980 Ford et al.
D257,687 S 12/1980 Bechtel
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A 10/1985 Rickling
4,558,531 A 12/1985 Kilby
D283,561 S 4/1986 Geist
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,716,673 A 1/1988 Williams et al.
4,721,205 A 1/1988 Burt et al.
4,723,472 A 2/1988 Lee
4,729,186 A 3/1988 Rieger et al.
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,815,593 A 3/1989 Brown
4,819,359 A 4/1989 Bassett
4,821,422 A 4/1989 Porter
4,821,443 A 4/1989 Bianco
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,406 A 1/1990 French
4,890,847 A 1/1990 Cartee et al.
4,896,446 A 1/1990 Gregory
D306,234 S 2/1990 Ferstl
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell et al.
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso, Jr
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,233,779 A 8/1993 Shaw
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,320,223 A 6/1994 Allen
5,328,029 A 7/1994 Chow et al.
5,332,185 A 7/1994 Walker, III
5,333,829 A 8/1994 Bell et al.
5,335,578 A 8/1994 Lorden et al.
5,337,505 A 8/1994 Brown et al.
5,344,012 A 9/1994 Matthews
5,347,740 A 9/1994 Rather et al.
5,351,428 A 10/1994 Graham
5,358,254 A 10/1994 Yeh et al.
5,361,505 A 11/1994 Faughn 5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,394,983 A 3/1995 Latulippe et al.
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
5,446,987 A 9/1995 Lee et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,525,314 A 6/1996 Hurson
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,588,242 A 12/1996 Hughes
5,600,913 A 2/1997 Minneman
5,617,666 A 4/1997 Scott
5,622,344 A 4/1997 Gracie
5,628,135 A 5/1997 Cady
D380,116 S 6/1997 Minneman
5,640,944 A 6/1997 Minneman
5,644,862 A 7/1997 Folmer
5,649,465 A 7/1997 Beebe
5,651,207 A 7/1997 Knight
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,711,102 A 1/1998 Plaster et al.
5,711,103 A 1/1998 Keng
5,715,625 A 2/1998 West, III
D391,616 S 3/1998 Plybon
5,723,183 A 3/1998 Williams et al.
5,723,806 A 3/1998 Odom
5,725,096 A 3/1998 Winnard
5,737,865 A 4/1998 Brandl et al.
5,740,625 A 4/1998 Jenkins
5,743,395 A 4/1998 Backer
5,758,447 A 6/1998 Venetz
5,758,933 A 6/1998 Clendening
5,761,954 A 6/1998 Dvorak
5,778,589 A 7/1998 Teague
5,779,527 A 7/1998 Maebashi
5,811,720 A 9/1998 Quinnell et al.
5,813,131 A 9/1998 Werre
5,815,974 A 10/1998 Keng
5,833,308 A 11/1998 Strong, III et al.
D403,176 S 12/1998 Harper
5,845,774 A 12/1998 Hausknecht
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,422 A 6/1999 Cote et al.
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,959,613 A 9/1999 Rosenberg et al.
5,970,642 A 10/1999 Martin
5,974,719 A 11/1999 Simonek
6,019,375 A 2/2000 West, Jr.
6,021,891 A 2/2000 Anderson
6,032,796 A 3/2000 Hopper et al.
6,042,080 A 3/2000 Shepherd et al.
6,044,747 A 4/2000 Felts
6,058,641 A 5/2000 Vecqueray
6,073,381 A 6/2000 Farrar et al.
6,086,375 A 7/2000 Legros
6,092,662 A 7/2000 Frederick, Jr.
6,110,020 A 8/2000 Rolfi
6,121,556 A 9/2000 Cole
6,237,462 B1 5/2001 Hawkes et al.
6,254,100 B1 7/2001 Rinehart
6,260,463 B1 7/2001 Brand et al.
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore, Jr. et al.
6,397,720 B1 6/2002 Fox et al.
6,439,515 B1 8/2002 Powers
6,439,530 B1 8/2002 Schoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,733,375 B2 5/2004 Hoffman
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher
6,862,833 B1 3/2005 Gurtner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
7,159,711 B1 1/2007 Gardner
7,165,750 B2 1/2007 McCuskey et al.
7,188,445 B2 3/2007 Lehman
D540,904 S 4/2007 Werner
7,207,567 B1 4/2007 Brown
D543,604 S 5/2007 Minneman
7,213,494 B2 5/2007 James
7,225,050 B2 5/2007 Sutula, Jr.
D553,219 S 10/2007 Potterfield
7,281,346 B1 10/2007 Cook et al.
D567,895 S 4/2008 Cauley

| | | | |
|---|---|---|---|
| 7,356,960 | B1 | 4/2008 | Knitt |
| 7,356,961 | B2 | 4/2008 | Williams |
| 7,357,250 | B2 | 4/2008 | Hagemann et al. |
| 7,363,740 | B2 | 4/2008 | Kincel |
| 7,367,451 | B2 | 5/2008 | Pendergraph et al. |
| 7,401,431 | B2 | 7/2008 | Pierce et al. |
| D576,245 | S | 9/2008 | Potterfield et al. |
| 7,421,815 | B1 | 9/2008 | Moody et al. |
| 7,426,800 | B2 | 9/2008 | Pierce et al. |
| 7,536,820 | B2 | 5/2009 | Wade et al. |
| 7,549,247 | B1 | 6/2009 | Reese |
| 7,584,690 | B2 | 9/2009 | Cauley |
| D605,246 | S | 12/2009 | Hobbs |
| 7,631,455 | B2 | 12/2009 | Keng et al. |
| 7,654,498 | B1 | 2/2010 | Beltz |
| 7,676,977 | B1 | 3/2010 | Cahill et al. |
| 7,681,886 | B2 | 3/2010 | Morrow et al. |
| 7,726,478 | B2 | 6/2010 | Potterfield et al. |
| 7,730,824 | B1 | 6/2010 | Black |
| 7,779,572 | B2 * | 8/2010 | Potterfield et al. ..... 42/94 |
| 2002/0113372 | A1 | 8/2002 | Love |
| 2002/0195752 | A1 | 12/2002 | Yang |
| 2003/0079395 | A1 | 5/2003 | Chong |
| 2004/0020097 | A1 | 2/2004 | Deros |
| 2004/0112777 | A1 | 6/2004 | Huang |
| 2004/0134113 | A1 | 7/2004 | Deros et al. |
| 2005/0000141 | A1 | 1/2005 | Cauley et al. |
| 2005/0011101 | A1 | 1/2005 | Gooder |
| 2005/0115137 | A1 | 6/2005 | Minneman |
| 2005/0178039 | A1 | 8/2005 | Flores |
| 2005/0183319 | A1 | 8/2005 | Franks |
| 2005/0188597 | A1 | 9/2005 | Keng et al. |
| 2005/0242250 | A1 * | 11/2005 | Keng et al. ..... 248/168 |
| 2006/0063653 | A1 | 3/2006 | Wickens et al. |
| 2006/0070900 | A1 | 4/2006 | Brunson et al. |
| 2006/0163534 | A1 | 7/2006 | Sugimoto et al. |
| 2006/0174532 | A1 | 8/2006 | Popikow |
| 2006/0175213 | A1 | 8/2006 | Hurt et al. |
| 2006/0218840 | A1 | 10/2006 | Cauley |
| 2006/0236584 | A1 | 10/2006 | Williams |
| 2006/0248774 | A1 | 11/2006 | Pierce et al. |
| 2006/0248775 | A1 | 11/2006 | Wade et al. |
| 2006/0254111 | A1 | 11/2006 | Giauque et al. |
| 2006/0277811 | A1 | 12/2006 | Peterson |
| 2006/0278797 | A1 | 12/2006 | Keng et al. |
| 2007/0029733 | A1 | 2/2007 | Anderson |
| 2007/0046760 | A1 | 3/2007 | Zara |
| 2007/0051028 | A1 | 3/2007 | Stordal |
| 2007/0068379 | A1 | 3/2007 | Sween et al. |
| 2007/0068835 | A1 | 3/2007 | Buie |
| 2007/0074439 | A2 | 4/2007 | Cauley et al. |
| 2007/0074440 | A2 | 4/2007 | Cauley |
| 2007/0094911 | A1 | 5/2007 | Rush et al. |
| 2007/0113460 | A1 | 5/2007 | Potterfield et al. |
| 2007/0175077 | A1 | 8/2007 | Laney et al. |
| 2007/0256346 | A1 | 11/2007 | Potterfield et al. |
| 2007/0262529 | A1 | 11/2007 | Gamez et al. |
| 2007/0266610 | A1 | 11/2007 | Coffield |
| 2007/0294929 | A1 | 12/2007 | Potterfield et al. |
| 2007/0294930 | A1 | 12/2007 | Mays |
| 2007/0295197 | A1 | 12/2007 | Potterfield |
| 2008/0023379 | A1 | 1/2008 | Potterfield et al. |
| 2008/0034636 | A1 | 2/2008 | Potterfield et al. |
| 2008/0041700 | A1 | 2/2008 | Potterfield et al. |
| 2008/0047189 | A1 | 2/2008 | Potterfield et al. |
| 2008/0054570 | A1 | 3/2008 | Potterfield et al. |
| 2008/0061509 | A1 | 3/2008 | Potterfield |
| 2008/0127815 | A1 | 6/2008 | Yale et al. |
| 2008/0128002 | A1 | 6/2008 | Jeffs |
| 2008/0156671 | A1 | 7/2008 | Jansson |
| 2008/0163534 | A1 | 7/2008 | Lombardi |
| 2008/0168697 | A1 | 7/2008 | Potterfield et al. |
| 2008/0174071 | A1 | 7/2008 | Potterfield et al. |
| 2008/0295379 | A1 | 12/2008 | Potterfield et al. |
| 2009/0020447 | A1 | 1/2009 | Potterfield et al. |
| 2009/0049731 | A1 | 2/2009 | Seuk |
| 2009/0056192 | A1 | 3/2009 | Oz |
| 2009/0064559 | A1 | 3/2009 | Potterfield et al. |
| 2009/0126250 | A1 | 5/2009 | Keng |
| 2010/0116163 | A1 | 5/2010 | Zara |
| 2010/0126055 | A1 | 5/2010 | Potterfield |
| 2010/0236125 | A1 | 9/2010 | Morrow et al. |
| 2011/0024985 | A1 | 2/2011 | Potterfield et al. |
| 2011/0079524 | A1 | 4/2011 | Potterfield et al. |

FOREIGN PATENT DOCUMENTS

| | | | |
|---|---|---|---|
| EP | 0624455 | A2 | 11/1994 |
| GB | 475080 | A | 11/1937 |

OTHER PUBLICATIONS

U.S. Appl. No. 11/679,832, filed Feb. 27, 2007, Cauley et al.
U.S. Appl. No. 11/739,077, filed Apr. 23, 2007, Cauley et al.
U.S. Appl. No. 11/862,821, Cesternino.
U.S. Appl. No. 11/935,381, filed Nov. 5, 2007, Potterfield.
U.S. Appl. No. 11/937,466, filed Nov. 8, 2007, Potterfield et al.
U.S. Appl. No. 12/037,336, filed Feb. 26, 2008, Potterfield.
U.S. Appl. No. 12/117,668, filed May 8, 2008, Potterfield et al.
U.S. Appl. No. 12/172,848, filed Jul. 14, 2008, Cesternino et al.
U.S. Appl. No. 12/177,032, filed Jul. 21, 2008, Potterfield et al.
U.S. Appl. No. 12/276,229, filed Nov. 21, 2008, Cauley et al.
U.S. Appl. No. 12/476,041, filed Jun. 1, 2009, Cauley.
U.S. Appl. No. 12/578,393, filed Oct. 13, 2009, Morrow et al.
U.S. Appl. No. 12/623,238, filed Nov. 20, 2009, Potterfield.
U.S. Appl. No. 12/769,438, filed Apr. 28, 2010, Potterfield.
U.S. Appl. No. 12/846,543, filed Jul. 29, 2010, Potterfield.
"American Rifleman: What to do about recoil," LookSmart, http://www.findarticles.com/p/articles/mi_qa3623/is_199907/ai_n8861959/print, pp. 1-4 [Internet accessed on Jan. 4, 2006].
"Cabela's Rotary Media Separator," http://www.cabelas/en/templates/links/link.jsp;jsessionid=QYVQMKM0P0P5 . . . , 2 pages [Internet accessed Apr. 24, 2007].
"Cleaning Cradles: Sinclaire Cleaning Cradles" p. 21, The date on which the Sinclair Folding Cleaning Cradle was first on sale is not known, but is believed to be circa 2004.
"Decker Rifle Vise," 1 page. The date on which the Decker Rifle Vise was first on sale is not known but is believed to be circa 2004.
"Eforcity Magnetic Screwdriver Set w/15 bits Great for Cellphones, Computers Includes: T6, TORX, Security TORX, Philips, Slotted, Spanner, Tri-Wing, Bent Pry Tool, Round Awl, Reset Pin for Game Boy Advance, Nintendo Wii, DS lite, NDS, Apple TV" , Amazon.com , accessed on Sep. 18, 2007.
"Gun Rest—Shooting Rest—Rifle Rests," http://www.jexploreproducts.com/gunrests-shootingrests.htm, 6 pages [Internet accessed Jul. 18, 2008].
"Plano Shooters Case, Brown Camo," The Sportsman's Guide, http://www.sportmansguide.com/cb/cb.asp?a=148225, the date on which the Plano Shooters Case was first on sale is not known but is believed to be circa 2004, 3 pages [Internet accessed no Oct. 11, 2006].
"Reloading Manual Number Ten for Rifle and Pistol," The Cartridge Components, SPEER Omark Industries, pp. 28-54.
"Shotshell reloading with a GRABBER," MEC—Mayville Engineering Company, Inc., pp. 1-12.
"The Grabber and Hustler '76," MEC—Mayville Engineering Company, Inc., 2 pgs, date unknown.
"Uncle Bud'S Bull Bags," http:www.unclebudscss.com/pages/Bulls%20bags.html, 2 pgs. [Internet accessed on Feb. 14, 2006].
"Uncle Bud'S Udder Bag," http:www.unclebudscss.com/pages/Udder%20Bags.html, 2 pgs. [Internet accessed on Feb. 14, 2006].
1shop2.com "Hoppe's Gunsmith's Fully Adjustable Bench Vise" 3 pages. The date on which The Hoppe's Gunsmith's Fully Adjustable Bench Vise was first on sale is not known, but is believed to be circa 2004.
AcuSport, Outdoor Sporting Products, 3 pgs., undated.
Amazon.com, "CTK® P3 Ultimate Shooting Rest," Sports & Outdoors, http://www.amazon.com/CTK%C2%AE-P3-Ultimate-Shooting-Rest/dp/ . . . , 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin . . . , 1 page [Internet accessed on Jul. 22, 2008].

Amazon.com, "Stoney Point Adjustable Shooting Rest w/Bag," Sports & Outdoors, http://www.amazon.com/Stoney-Point-Adjustable-Shooting-Rest/dp/B0 . . . , 1 page [Internet accessed on Jul. 22, 2008].
Auto-Flo Lyman Turbo 1200 Tumbler, 2 pages [product photos].
Basspro.com, "Bass Pro Shops Outdoors Online: Offering the best in Fishing, Hunting and Outdoor Products," http://www.basspro.com/webapp/wcs/stores/servlet/Product_10151_-1_10001_95064_SearchResults, 2 pages [Internet accessed on Aug. 6, 2008].
Battenfeld Technologies, Inc., "Gun Vise," Tipton Gun Cleaning Supplies, Battenfeld Technologies, Inc. 2004 Catalog, p. 32, Product No. 782-731, 2 pgs.
Battenfeld Technologies, Inc., "Steady Rest Portable Shooting Rest," 1 page [Internet accessed Jan. 25, 2006].
Big Boy Gun Toys, "Shooting Rest," http://www.bigboyguntoys.com/shootingrest.htm, 1 page [Internet accessed on Jul. 18, 2008].
Birchwood Casey 2005 Catalog, 28 pages.
Birchwood Casey 2006 Catalog. The date of availability of this catalog is unknown, but is believed to be in Jan. 2006 or later. pp. 5-17.
Birchwood Casey, "Dirty Bird@Splattering Targets," http://www.birchwoodcasey.com/sport/target_index.asp?categoryID=4 &subcat=22 , pp. 1-4, internet accessed Jan. 16, 2006.
Birchwood Casey, "Shoot•N•C® Targets," http://www.birchwoodcasey.com/sport/target_index.asp?categoryID=4 &subcat=8, pp. 1-8, internet accessed Jan. 16, 2006.
Birchwood Casey, "Targets Spots®." http://www.birchwoodcasey.com/sport_index.asp?categoryID=4&subcat=12 , pp. 1-2, internet accessed Jan. 16, 2006.
Birchwood Casey, "World of Targets®" http://www.birchwoodcasey.com/sport/target_index.asp?categoryID=4 &subcat=13 , pp. 1-4, internet accessed Jan. 16, 2006.
Boyt Harness Company, Product Catalog, http://www.boytharness.com/catalog/index.php?cPath=22, 2 pages [Internet accessed on Jul. 21, 2008].
Brass Cleaning Kits, http://www.berrysmfg.com/81.php, 1 page [Internet accessed Apr. 24, 2007].
Brownells Inc., Brownells Magna-Tip Screwdriver, Brownells Catalog No. 54 for 2001-2002, 2001, p. 151.
Brownells Inc., Brownells Magna-Tip Super-Sets, Brownells Catalog No. 54 for 2001-2002, 2001, p. 153.
Brownells Inc., Catalog No. 41 1988-1989 3 pages (8909).
Brownells Inc., Catalog No. 47 1994-1995 2 pages (8909).
Brownells Inc., Catalog No. 57. For 2004-2005. 2 pages.
Brownells Inc., Sight Base Cutters, Faxed Dec. 17, 2003, 1 page.
B-Square , Pro Gunsmith Screwdriver Set, B-Square Mounts Tools Accessories Product Catalog, p. 23, date unknown.
Cabela's "Master Catalog Fall 2003: Late-Season Edition" Cover page and p. 416. 2 pages.
Cabela's Hunting Fishing and Outdoor Gear Master Catalog, Fall 2002, Edition II, Minimizer Rifle Rest, Item No. SC-22-4332, p. 492.
Cabela's, "BenchBuddy® Gun Rest," http://www.cabelas.com/cabelas/en/templates/links/link.jsp?id=0005819221954a &type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product &cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a &type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a &type=product&cmCat=, © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product &cmCat=. . . , © 1996-2008, 2 pages [Internet accessed on Aug. 6, 2008].
Cabela's, "Secure Bench Rest," http://www.cabelas.com/cabelas/en/templates/links/link.jsp;jsessionid=4F0LP0OW2HMRLLAQBBISCOF . . . , © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a &type=product&cmCat=, © 1996-2008, 2 pages [Internet accessed on Aug. 6, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
Cabela's, "Sure Shot Shooting Vise/Rest," http://www.cabelas.com/cabelas/en/templates/product/standard-item.jsp?id= 00348272277 . . . , © 1996-2008, 2 pages [Internet accessed on Jul. 15, 2008].
Cabela's, "HySkore Sighting System and Cleaning Vise," the date on which the HySkore Sighting System and Cleaning Vise was first on sale is not known, but is believed to be circa Jan. 2005. However, a prototype of this product may have been shown to buyers at Cabela's circa Aug. 2004, 1 page.
Caldwell Insta-View™ 4" Targets.
Caldwell Shooting Supplies, 2006 Catalog, pp. 18, 5, 12, 14 and 15.
Caldwell Shooting Supplies, Targets & Target Accessories, Instra-View™ Targets, 1 page.
Caldwells Insta-View 4" Targets, 1 page [product photo].
Californiavarmintcallers.com—Forum, http://californiavarmintcallers.com/community/modules/newbb/viewtopic.php?topic_id=10 &forum=9&PHPSESSID=074ed8c7 . . . , pp. 1-4, accessed Jan. 16, 2006.
Canadian Camo, "Gun Rest," http://media5.magma.ca/www.canadiancamo.com/catalog/product_info.php?products_id=. . . , 2 pages [Internet accessed on Feb. 13, 2006].
Carmichael, J., "Reloading for Accuracy," Lyman Reloading Handbook, 46th Edition, pp. 68-77.
Champion Targets, "Next Generation Paper Targets," http://www.championtarget.com/products/targets/next_generation_targets.aspx , pp. 1-3, [internet accessed Jan. 16, 2006].
Champion Traps & Target, 2005 Product Catalog , 12 pages.
Chastain, R., "Load 'em Up!" About.com: Hunting/Shooting, http://hunting.about.com/od/reloadinginfo/a/aaloademup_2htm , 6 pages [Internet accessed on Aug. 31, 2007].
Cork Industries, Inc., "Double Bumping Coating Applications," Cork Tech TalkNews, Feb. 1997, 2 pages.
CTK Precision, "P3 Ultimate Shooting Rest," http://www.ctkprecision.com/index.asp?PageAction=VIEWPROD&ProdOID=2, 3 pages [Internet accessed on Jul. 18, 2008].
CTK Precision, All Products, http://www.ctkprecision.com/index.asp?PageAction=VIEWCATS&Cate . . . , 3 pages [Internet accessed on Jul. 22, 2008].
CV-500, 3 pages [product photos].
Device manufactured by Shooter's Ridge, a division of ATK, and available at least by late 2005, 1 page.
Dillon Precision CV-500 Cartridge Case Vibratory Cleaner, 6 pages [product photos].
E. Arthur Brown Company, "A Shooting Rest that Really Works . . . ," http://www.eabco.com/TargetShooting01.html, © 2007-2008, 1 page [Internet accessed Jul. 18, 2008].
Edgewood Shooting Bags Catalog, http://www.edgebag.com/catalog.php, 7 pages [Internet accessed on Feb. 14, 2006].
Ellett Brothers, Rests & Gun Vises, pp. 621-622, date unknown.
Final Office Action; U.S. Appl. No. 10/865,595; Mailed on Apr. 3, 2007, 10 pages.
Final Office Action; U.S. Appl. No. 11/206,430; Mailed on Oct. 29, 2007, 13 pages.
Final Office Action; U.S. Appl. No. 11/206,430; Mailed on Nov. 24, 2008, 12 pages.

Final Office Action; U.S. Appl. No. 11/206,430; Mailed on Apr. 1, 2010, 14 pages.
Final Office Action; U.S. Appl. No. 11/271,100; Mailed on Sep. 22, 2008, 8 pages.
Final Office Action; U.S. Appl. No. 11/339,863; Mailed on Mar. 10, 2009, 6 pages.
Final Office Action; U.S. Appl. No. 11/431,956; Mailed on Nov. 27, 2009, 13 pages.
Final Office Action; U.S. Appl. No. 11/505,784; Mailed on Dec. 19, 2008, 10 pages.
Final Office Action; U.S. Appl. No. 11/507,683; Mailed on Apr. 6, 2010. 7 pages.
Final Office Action; U.S. Appl. No. 11/607,550; Mailed on Nov. 27, 2009, 14 pages.
Final Office Action; U.S. Appl. No. 11/679,100; Mailed on Aug. 3, 2009, 9 pages.
Final Office Action; U.S. Appl. No. 11/679,136; Mailed on Apr. 10, 2009, 22 pages.
Final Office Action; U.S. Appl. No. 11/679,832; Mailed on Jun. 8, 2010, 12 pages.
Final Office Action; U.S. Appl. No. 11/801,341; Mailed on Sep. 30, 2009, 6 pages.
Final Office Action; U.S. Appl. No. 11/844,980; Mailed on May 25, 2010, 6 pages.
Final Office Action; U.S. Appl. No. 11/853,763; Mailed on Jul. 13, 2009, 7 pages.
Final Office Action; U.S. Appl. No. 12/476,041; Mailed on Jul. 20, 2010, 7 pages.
Grafix Plastics, http://grafixplastic.com/plastic_film_g.asp?gclid=CK-5-_7gnY4CFRVNhgodjFhfSQ , 29 pages [Internet accessed on Aug. 30, 2007].
Harris, J. et al., "The Art and Science of Annealing," http://www.6mmbr.com/annealing.html, © 2005, 13 pages [Internet accessed on Aug. 13, 2007].
Hyskore, "Rest—Dangerous Game Machine Rest," Hyskore Rest, Professional firearm rests, http://www.hyskore.com/rests.htm, 2 pages [Internet accessed Jul. 21, 2008].
Hyskore: Professional Shooting Accessories. "Dangerous Game Machine Rest," Accessed Feb. 22, 2006 www.hyskore.com, 10 pages.
Hyskore: Professional Shooting Accessories. "Hydraulic Trigger Release." Accessed Feb. 22, 2006. www.hyskore.com 7 pages.
International Search Report and Written Opinion; International Patent Application No. PCT/US07/76440; Filed: Aug. 21, 2007; Applicant: Battenfeld Technologies, Inc.; Mailed on Sep. 30, 2008.
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Joe's, "Shooter's Ridge Steady Point Shooting Rest," http://www.joessport.com/product/index.jsp?productID=3155005&cp=726872&parentpag . . . , Item No. 3155005, 1 page [Internet accessed Jul. 17, 2008].
Lahti Company Brochure, "Rock Solid Hold," Rifle Evaluator, http://www.lathicompany.com/Forms/EvaluatorBrochure2.jpg, 2 pages. [Internet accessed Jan. 16, 2006].
Lahti Company Brochure, "Rifle Evaluator: No Pain, No Fear, No Flinching, No Body Movement," www.lahticompany.com, 2 pages, undated.
Lee Precision, Inc., "Load-All," 1 page.
Lee Precision, Inc., "The World's Fastest Handloading Press . . . Lee Progressive 1000," 1985 Catalog, pp. 1-15.
Lohman Sight Vise, 4 pages product photographs, the date on which the Lohman Site Vise was first on sale is not known, but is believed to be circa 2004.
Lyman Hornady Case Tumbler, 2 pages [product photos].
Lyman Turbo 600 Tumbler, 3 pages [product photos].
Lyman Turbo Pro 1200 Tumber, 2 pages [product photos].
Lyman, "A History of Lyman Metallic Reloading," Reloading Handbook, 46th Edition, pp. 10-31.
Lyman, "Introduction to Reloading," Reloading Handbook, 46th Edition, pp. 170-203.
MacksPW.com, "Desert Mountain Bench Master Rifle Rest," http://www.macksqw.com/Item—i-DESBM1, © 2004-2008, 1 page [Internet accessed Jul. 22, 2008].
Midway USA, Chapman 27-Piece Deluxe Screwdriver Set, Master Catalog and Reference Guide #2, 2004, p. 440.
Midway USA, Pachmayr Professional Screwdriver Set, Master Catalog and Reference Guide #2, 2004, p. 448.
Midway USA, Wheeler Engineering Space-Saver Gunsmithing Screwdriver Set, Master Catalog and Reference Guide #2, 2004, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pages [Internet accessed on Jul. 21, 2008].
MidwayUSA, "Stoney Point Bench Anchor Rifle Shooting Rest," http://www.midwayusa.com/eproductpage.exe/showproduct?saleitemid=34717484&t=11082005, 2005, 2 pages [Internet accessed on Aug. 6, 2008].

Milek. B., "Handloading for Hunting" New Products from RCBS, Lee, Accurate Arms, Peterson's Hunting, Mar. 1985. p. 21.
Millett, "BenchMaster Shooting Rests," 1 page, Undated.
MTM Case-Gard, "Gun Maintenance Centers," http://www.mtmcase-gard.com/products/shooting/gunm.html, the date on which the MTM Gun Maintenance Center was first on sale is not known, but is believed to be circa 2004, 2 pages [Internet accessed Oct. 11, 2006].
MTM Case-Gard, "MTM Shoulder-Gard Rifle Rest," Cover Photo for Rest, p. 2, date unknown.
MTM Case-Gard, "Rifle rest and pistol shoot rest, " http://www/mtmcase-gard.com/products/shooting/shoo.html, the date on which the MTM Site-In-Clean was first on sale is not known, but is believed to be circa 2004, 3 pages [Internet accessed on Oct. 11, 2006].
Non-Final Office Action; U.S. Appl. No. 10/865,595; Mailed on Jun. 7, 2006, 8 pages.
Non-Final Office Action; U.S. Appl. No. 11/206,430; Mailed on Jun. 23, 2009, 13 pages.
Non-Final Office Action; U.S. Appl. No. 11/206,430; Mailed on May 14, 2008, 10 pages.
Non-Final Office Action; U.S. Appl. No. 11/206,430; Mailed on May 21, 2007, 12 pages.
Non-Final Office Action; U.S. Appl. No. 11/271,100; Mailed on Mar. 26, 2008, 9 pages.
Non-Final Office Action; U.S. Appl. No. 11/311,530; Mailed on Feb. 13, 2007, 10 pages.
Non-Final Office Action; U.S. Appl. No. 11/339,863; Mailed on Sep. 23, 2008, 7 pages.
Non-Final Office Action; U.S. Appl. No. 11/418,407; Mailed on Feb. 24, 2009, 9 pages.
Non-Final Office Action; U.S. Appl. No. 11/431,956; Mailed on Mar. 2, 2009, 16 pages.
Non-Final Office Action; U.S. Appl. No. 11/505,784; Mailed on Dec. 26, 2007, 14 pages.
Non-Final Office Action; U.S. Appl. No. 11/505,784; Mailed on Oct. 27, 2009, 8 pages.
Non-Final Office Action; U.S. Appl. No. 11/507,683; Mailed on Sep. 18, 2008, 8 pages.
Non-Final Office Action; U.S. Appl. No. 11/607,550; Mailed on Mar. 2, 2009, 11 pages.
Non-Final Office Action; U.S. Appl. No. 11/607,550; Mailed on Jun. 17, 2010, 12 pages.
Non-Final Office Action; U.S. Appl. No, 11/679,100; Mailed on Oct. 16, 2008, 11 pages.
Non-Final Office Action; U.S. Appl. No. 11/679,100; Mailed on May 28, 2010, 9 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/679,169; Mailed on Apr. 28, 2009, 11 pages.
Non-Final Office Action; U.S. Appl. No. 11/679,832; Mailed on Aug. 28, 2009, 9 pages.
Non-Final Office Action; U.S. Appl. No. 11/739,077; Mailed on Oct. 8, 2009, 7 pages.
Non-Final Office Action; U.S. Appl. No. 11/740,908; Mailed on Jan. 29, 2010, 8 pages.
Non-Final Office Action; U.S. Appl. No. 11/746,551; Mailed on Apr. 14, 2010, 8 pages.
Non-Final Office Action; U.S. Appl. No. 11/801,341; Mailed on Jan. 13, 2009, 7 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
Non-Final Office Action; U.S. Appl. No. 11/853,745; Mailed on Jun. 19, 2009, 11 pages.
Non-Final Office Action; U.S. Appl. No. 11/853,763; Mailed on Dec. 22, 2008, 6 pages.
Non-Final Office Action; U.S. Appl. No. 12/117,668; Mailed on Aug. 13, 2009, 15 pages.
Non-Final Office Action; U.S. Appl. No. 12/177,032; Mailed on Feb. 23, 2010, 6 pages.
Non-Final Office Action; U.S. Appl. No. 12/209,113; Mailed on Sep. 23, 2009, 6 pages.
Non-Final Office Action; U.S. Appl. No. 12/276,229; Mailed on Aug. 30, 2010, 8 pages.
Non-Final Office Action; U.S. Appl. No. 12/476,041; Mailed on Nov. 18, 2009, 6 pages.
Non-Final Office Action; U.S. Appl. No. 12/037,336; Mailed on Sep. 15, 2010, 33 pages.
Precision Shooting, Inc., Bald Eagle Front Rest, The Accurate Rifle, vol. 6, Issue No. 4, May 2003, p. 47.
Protektor Model, "The Original Leather Rifle and Pistol Rest," http://www.protektormodel.com/, 12 pages [Internet accessed on Feb. 14, 2006].
RCBS Automatic Primer Tool, pp. 68-71, undated.
RCBS, "Reloading Equipment," http://www.rcbs.com/default.asp?menu=1&s1=4&s2=3&s3=25, 1 page [Internet accessed Apr. 24, 2007].
Shooters Ridge, "Deluxe Rifle Rest," http://www.shootersridge.com, 1 page [Internet accessed Jul. 21, 2008].
Shooters Ridge, "Shooting Rest with Gun Vise," http://www.shootersridge.com, 1 page [Internet accessed Jul. 17, 2008].
Sinclair International, Sinclair Shooting Rests, Products for the Precision Shooter, 2002, Issue No. 2002-B pp. 76-78.
Sweeney, P., "Gunsmithing: Measure Headspace," Peterson's Rifleshooter, http://www.rifleshootermag.com/gunsmithing/headspace_0612/1, 4 pages [Internet accessed Dec. 11, 2004].
Tenex Precision Co., "Recoil A-Rest-R," 4 pages, date unknown [product photos].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
Non-Final Office Action; U.S. Appl. No. 12/172,848, Mailed on Nov. 22, 2010, 32 pages.
Non-Final Office Action; U.S. Appl. No. 11/206,430; Mailed on Oct. 14, 2010, 18 pages.
Non-Final Office Action; U.S. Appl. No. 12/276,223; Mailed on Dec. 27, 2010, 37 pages.
Non-Final Office Action; U.S. Appl. No. 11/431,956; Mailed on Feb. 9, 2011, 13 pages.
Non-Final Office Action; U.S. Appl. No. 11/746,551; Mailed on Jul. 8, 2011, 14 pages.
Non-Final Office Action; U.S. Appl. No. 12/769,438; Mailed on Jul. 15, 2011, 55 pages.
Non-Final Office Action; U.S. Appl. No. 12/276,223; Mailed on Jul. 19, 2011, 11 pages.
Non-Final Office Action; U.S. Appl. No. 12/177,032; Mailed on Aug. 15, 2011, 9 pages.
Final Office Action; U.S. Appl. No. 11/679,100: Mailed on Feb. 18, 2011, 11 pages.

* cited by examiner

BIPOD DEVICE FOR USE WITH A FIREARM

CROSS-REFERENCE TO RELATED APPLICATION

This application is a continuation of U.S. patent application Ser. No. 11/801,341, filed May 8, 2007, now U.S. Pat. No. 7,779,572, which claims the benefit of U.S. Provisional Patent Application No. 60/798,700, filed May 8, 2006, and U.S. Provisional Patent Application No. 60/798,873, filed May 9, 2006, the disclosures of which are incorporated by reference herein.

TECHNICAL FIELD

The present disclosure is directed to bipods and mounting devices for attaching to and supporting firearms, more specifically, the disclosure is directed to bipods which allow independent tension-adjustable movement around two axes.

BACKGROUND

Modern firearms, such as rifles in particular, may be more accurately and conveniently fired by the shooter if the firearm is equipped with a bipod device for supporting and steadying the barrel. Bipods may be fixedly or removeably mounted onto firearms and have been found to be most convenient if they can further be retracted in a storage position when not in use. Exemplary bipods and mounting devices are taught in prior U.S. Pat. No. 3,327,422 issued Jun. 27, 1967; U.S. Pat. No. 4,470,216 issued Sep. 11, 1984; U.S. Pat. No. 4,625,620 issued Dec. 2, 1986; and U.S. Pat. No. 4,641,451 issued Feb. 10, 1987; U.S. Pat. No. 4,903,425 issued Feb. 27, 1990; and U.S. Pat. No. 5,711,103 issued Jan. 27, 1998 the disclosures of which are incorporated herein by reference in their entirety. However, there remain various desirable improvements which have not yet been recognized in the prior art, but are addressed in the present invention.

For example, in various prior art disclosures, the attachment means that connect the bipod to the mounting block fail to achieve a solid physical connection between the two; the result is a significant amount of wobble, which is undesirable when shooting a firearm. Other exemplary patents relevant to bipods include: U.S. Pat. No. 5,711,103 disclosing a mounting block to which a pair of legs is mounted, wherein the mounting block depends on a square "pulldown" and a U-shaped yoke system; U.S. Pat. No. 5,815,974 disclosing a bipod with legs that can be quickly detached from a mounting block; US. Publication No. 2005/0188597 A1 disclosing a mechanism for attaching an accessory to a Picatinny rail; and US Publication 2005/0242250 A1 disclosing a bipod that attaches to an existing mounting block and protruding stud, the disclosures of which are incorporated herein in their entirety. While the bipods disclosed in the prior art are functional, there exists a need to improve the stability, efficiency and design of bipods and bipod attachments for supporting firearms.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

A. Overview

Figure 1:
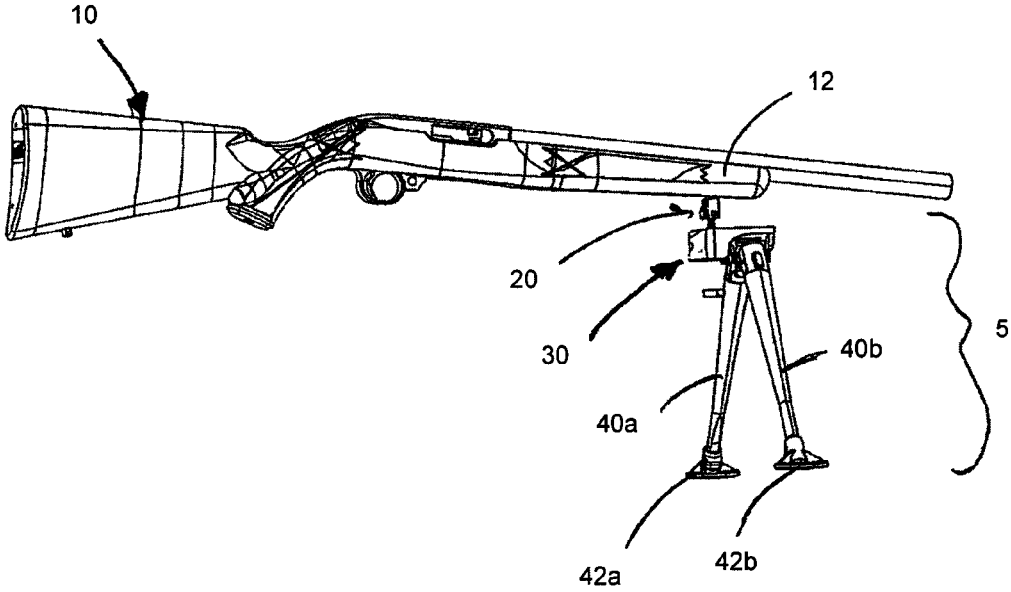
FIG. 1 is an isometric, partially exploded view of a bipod for supporting a firearm in accordance with one embodiment of the disclosure.

The following disclosure describes several embodiments of bipods for supporting a firearm. One aspect of the invention is directed to a bipod that allows tension-adjustable movement around two axes. Another aspect of the invention is directed to a bipod assembly that is tension-adjustable to allow cant movement of the bipod assembly relative to the firearm; tension-adjustable to allow pivot movement of the bipod assembly relative to the firearm; and/or tension-adjustable to independently allow pivot and cant movement of the bipod assembly relative to the firearm. In one embodiment, a bipod includes a stock mount bracket, a movement mechanism, a pair of legs, and a pair of corresponding feet. The stock mount bracket is removeably coupled to the stock of a firearm by a stock mount assembly. According to embodiments, the stock mount assembly attaches the bipod to the stock of a firearm without the use of specialized tools or by hand.

In yet another embodiment, an adjustment assembly is provided which allows the legs of the bipod to rotate or cant in a single plane which is generally perpendicular to the gun barrel direction. This allows the shooter to place the bipod and gun on an uneven surface quickly and without unnecessary canting of the rifle. In the adjustment assembly of the present invention the adjustment assembly is configured such that undesirable rattling type noises from the bipod assembly are diminished substantially. According to another embodiment, an attachment assembly may be attached to a sling swivel of a firearm. The attachment assembly includes a quick release feature whereby the bipod and moving parts thereto may be easily detached from the firearm without the use of a tool.

Another aspect is directed toward an attachment assembly for attaching an adjustment assembly contained in a bipod assembly to the stock of a firearm. The attachment assembly is configured to attach directly to the sling swivel provided on the firearm. The adjustment assembly is configured to provide pivotal movement about an axis to allow the shooter to rotate the firearm in a plane generally parallel to the firearm. The adjustment assembly may further be configured to provide rotational movement about a second axis generally transverse to the first axis to allow the shooter to cant the firearm to compensate for uneven ground and thus allow the shooter to maintain the firearm in an upright position. According to yet further embodiments, the adjustment assembly is configured to provide both pivotal movement about a first axis and rotational movement about a second perpendicular axis. According to this embodiment, the pivotal movement and rotational movement may be independently locked to prevent movement in one or both directions with a cam lock or other mechanical device.

In another embodiment, the bipod assembly includes a pair of legs having removable feet. The feet may be interchangeable and may be configured according to the condition the bipod assembly is expected to be used in, for example, a foot having a large contact surface area for marshy ground, and foot having a smaller contact surface area for paved or hard ground surfaces. In another embodiment, the feet may be attached or detached without the use of a tool. In another embodiment, the feet may be press fit onto a lower portion of the leg. In another embodiment, the feet include a quick connect mechanism such as a removable pin that is held in a detent notch in the foot and in a detent notch in the leg by spring pressure.

Another aspect of the invention is directed to methods of attaching bipods onto a firearm. In one embodiment, a method includes removably attaching an attachment assembly to a sling swivel of a firearm stock, coupling the attachment assembly to an adjustment assembly wherein the adjustment assembly allows movement of the firearm relative to the bipod assembly in pivotally in a first axis and rotationally in a second axis, removably attaching a pair of leg extensions to the adjustment assembly, and removably attaching feet to the pair of leg extensions.

Specific details of several embodiments of the invention are described below with reference to containers for carrying firearm accessories and/or supporting firearms. Several details describing well-known structures or processes often associated with bipods, bipod attachment mechanisms, and bipods for use supporting firearms are not set forth in the following description for purposes of brevity and clarity. Also, several other embodiments of the invention can have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 1-31.

Where the context permits, singular or plural terms may also include the plural or singular terms, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or other types of features and components are not precluded.

B. Bipod Embodiments

FIG. 1 is an isometric, partially exploded view of a bipod for supporting a firearm in accordance with one embodiment of the disclosure. A bipod assembly 5 is shown relative to a firearm 10 having a firearm stock portion 12. A sling swivel (not shown) is contained on an underside of the firearm stock portion 12 to provide a connection point for a sling. According to the illustrated embodiment, the bipod assembly 5 includes an attachment assembly 20, an adjustment assembly 30, a pair of leg extensions 40*a*, 40*b* and a pair of feet 42*a*, 42*b*. As further shown in FIG. 1, the attachment assembly 20 is configured to releasably couple to the sling swivel and the adjustment assembly 30 is configured to releasably couple to the attachment assembly 20. The pair of leg extensions 40*a*, 40*b* are coupled to the adjustment assembly 30, and corresponding feet 42*a*, 42*b* are coupled to the leg extensions 40*a*, 40*b*.

Figure 2:
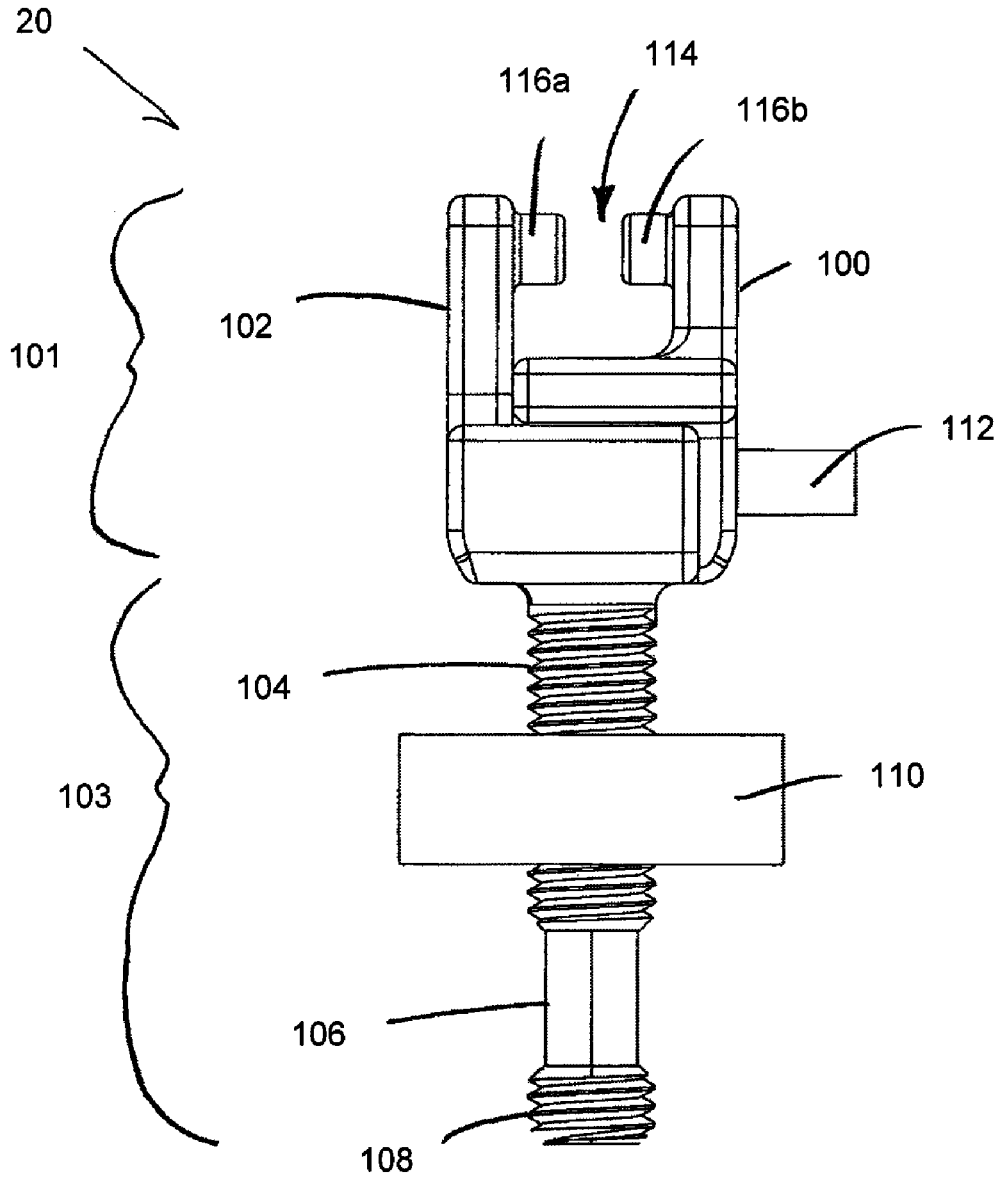
FIG. 2 is a schematic isometric view of an attachment assembly for attaching a bipod assembly to the stock of a firearm in accordance with another embodiment of the disclosure.

FIG. 2 is a schematic isometric view of an attachment assembly 20 for attaching a bipod assembly 5 to the stock of a firearm 10 in accordance with another embodiment of the disclosure. As shown in FIG. 2, the attachment assembly 20 includes a first portion 100 and a second portion 102. The second portion 102 and an upper portion of the first portion 100 combine to provide a stock engaging portion 101. Protrusions 116*a*, 116*b* are contained on an interior surface of the first and second portions 100, 102 to engage an eye of a sling swivel placed in space 114.

Figure 3:
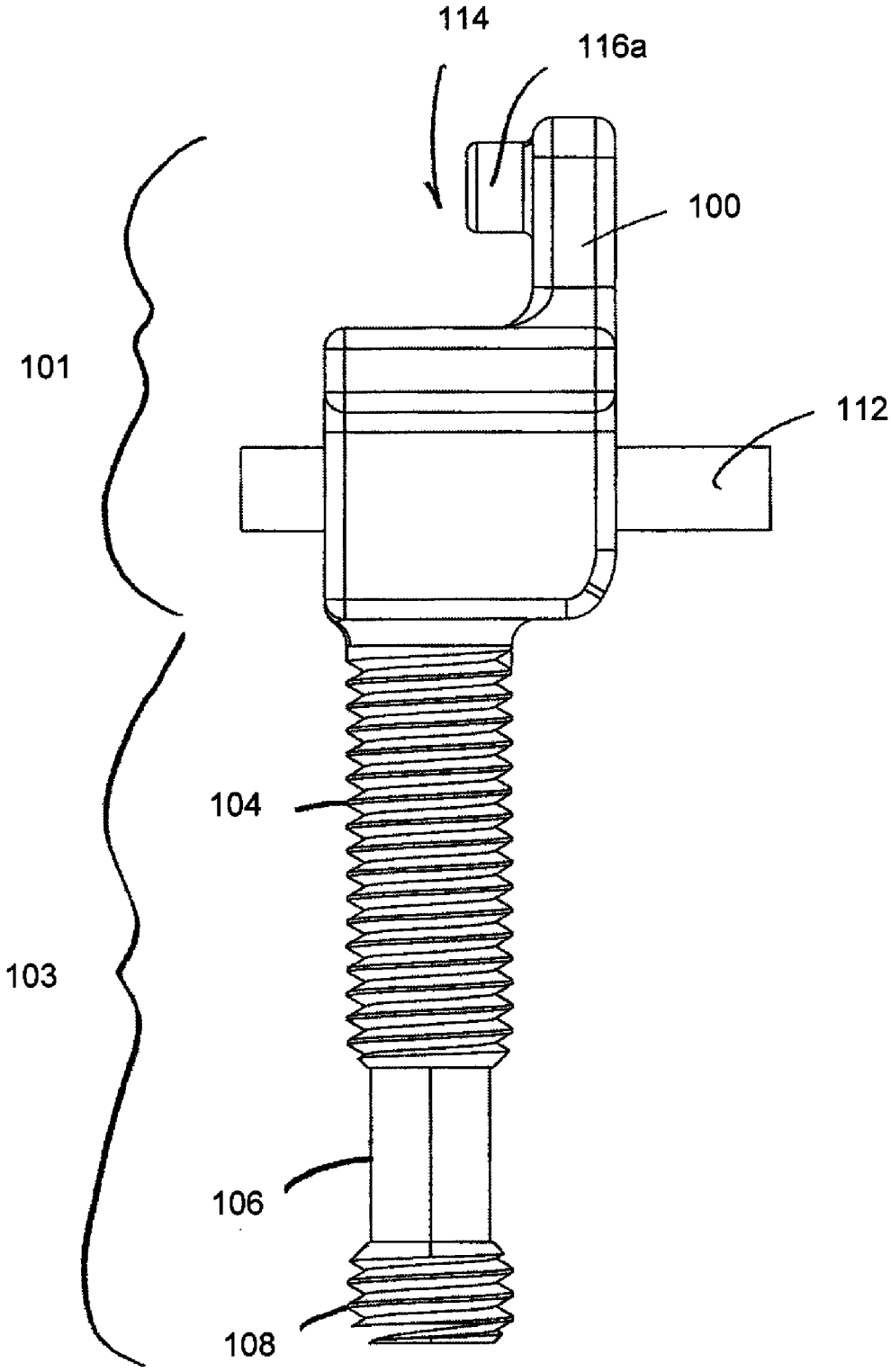
FIG. 3 is a schematic isometric view of a partial attachment assembly for use attaching a bipod assembly to the stock of a firearm in accordance with another embodiment of the disclosure.

FIG. 3 is a schematic isometric view of a partial attachment assembly 20 of FIG. 2. As further shown in FIG. 3, the first portion 100 of the attachment assembly 20 includes part of the stock engaging portion 101 and also a partially threaded portion 103 for engaging a washer 110. The partially threaded portion 103 includes threaded regions 104, 108 and non-threaded regions 106. The washer 110 includes reciprocal threads on an internal surface (not shown) to allow the washer 110 to rotate up or down the threaded portion 103. In operation, the washer 110 is tightened to draw the stock engaging portion into the stock mount bracket (see FIG. 4) and engage the protrusions 116*a*, 116*b* in space 114 with the sling swivel on the stock mount (not shown for purposes of clarity). As shown with respect to FIGS. 2 and 3, the attachment assembly further includes a release mechanism 112 for releasing the stock engaging portion 101 of the attachment assembly 20 from the sling swivel. The release mechanism 112 is shown as a push rod for pushing the first portion 100 away from the second portion 102 and thus disengaging the protrusions 116*a*, 116*b* from the sling swivel. Alternatively, as is know in the art, any mechanical release mechanism may be used to release the attachment assembly from the sling swivel.

Figure 4:
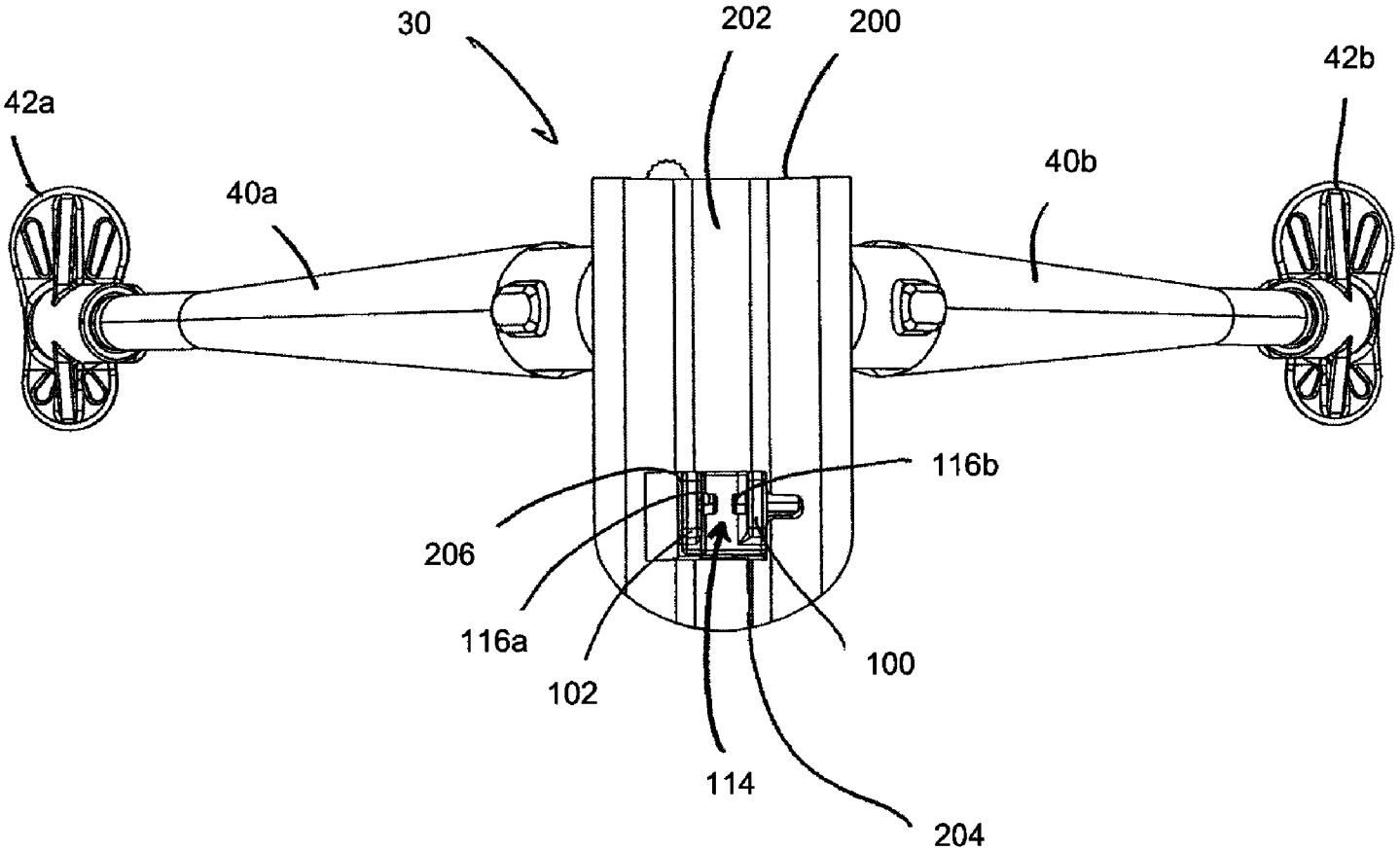
FIG. 4 is a schematic isometric top view of a bipod assembly for use supporting a firearm in accordance with one embodiment of the disclosure.

FIG. 4 is a schematic isometric top view of a bipod assembly 5 for use supporting a firearm in accordance with one embodiment of the disclosure. As shown in FIG. 4, a stock mount bracket 200 includes a top surface 202 configured to reciprocally mate with a bottom surface of the stock 12 of a firearm 10. The top surface 202 of the stock mount bracket 200 includes an aperture 204 for receiving the attachment assembly 20. The aperture 204 includes tapered walls 206 to draw the protrusions 116*a*, 116*b* together and further secure the attachment assembly 20 to the sling swivel of the firearm 10.

Figure 5:
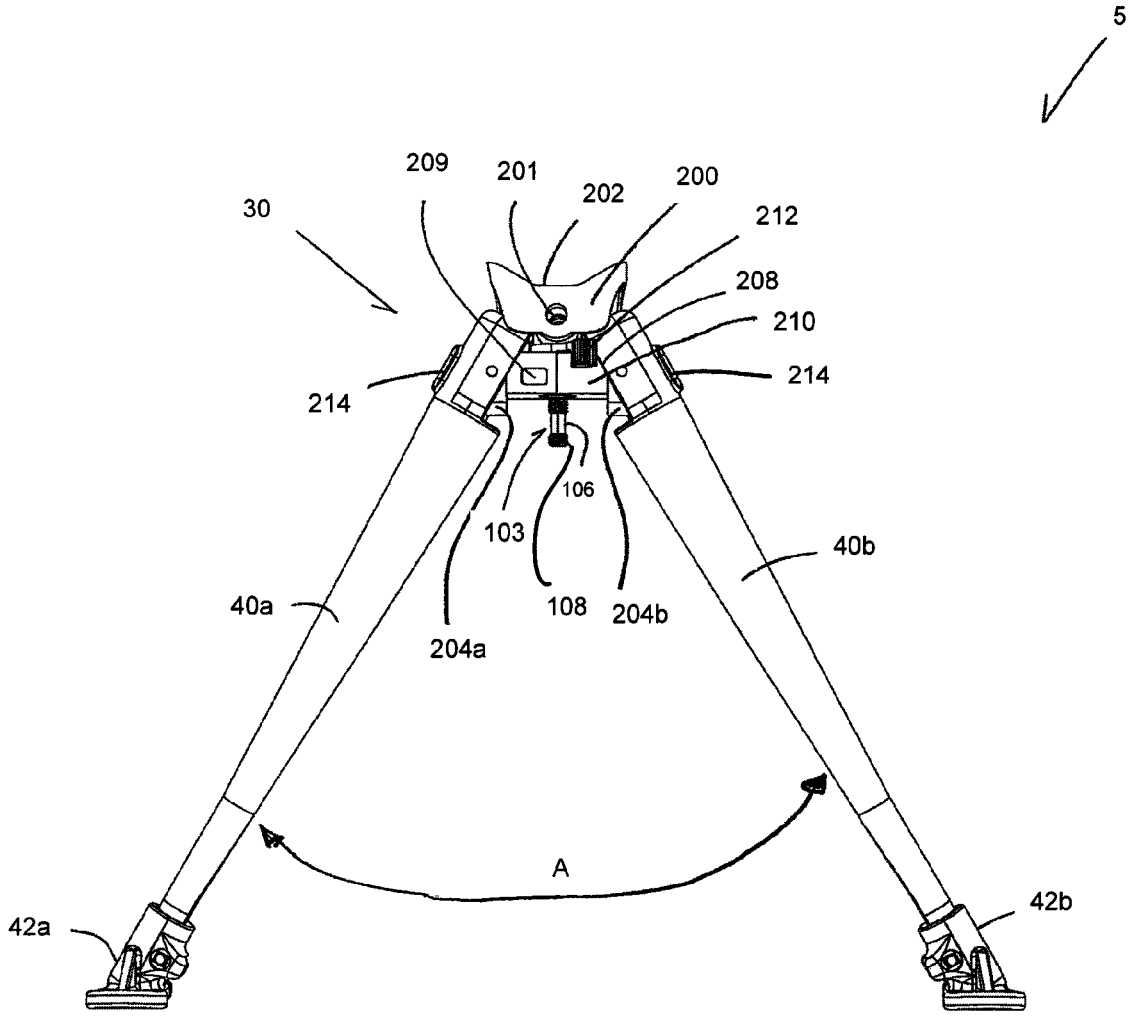
FIG. 5 schematic isometric front view of a bipod assembly for use supporting a firearm in accordance with one embodiment of the disclosure.

FIG. 5 schematic isometric front view of a bipod assembly 5 for use supporting a firearm 10 in accordance with one embodiment of the disclosure. As further shown in FIG. 4, the stock mount bracket 200 has a curved top surface 202, and an aperture 201 for receiving a pivot pin (shown with regard to FIG. 9). The bipod assembly 5 further includes a pivot bushing 210 and an interlocking cam bushing (shown in FIG. 6), a first cam lock 212 for preventing movement in a first direction and a second cam lock 216 for preventing movement in a second direction, leg extensions 40*a*, 40*b*, and removable feet 42*a*, 42*b*. The leg extensions further include leg release mechanisms 214 to allow legs to open to angle A. The pivot bushing 210 further includes a rotation inhibitor surface 208 for engaging the leg extensions 40*a*, 40*b* and stopping the legs at a predetermined angle apart.

Figure 6:
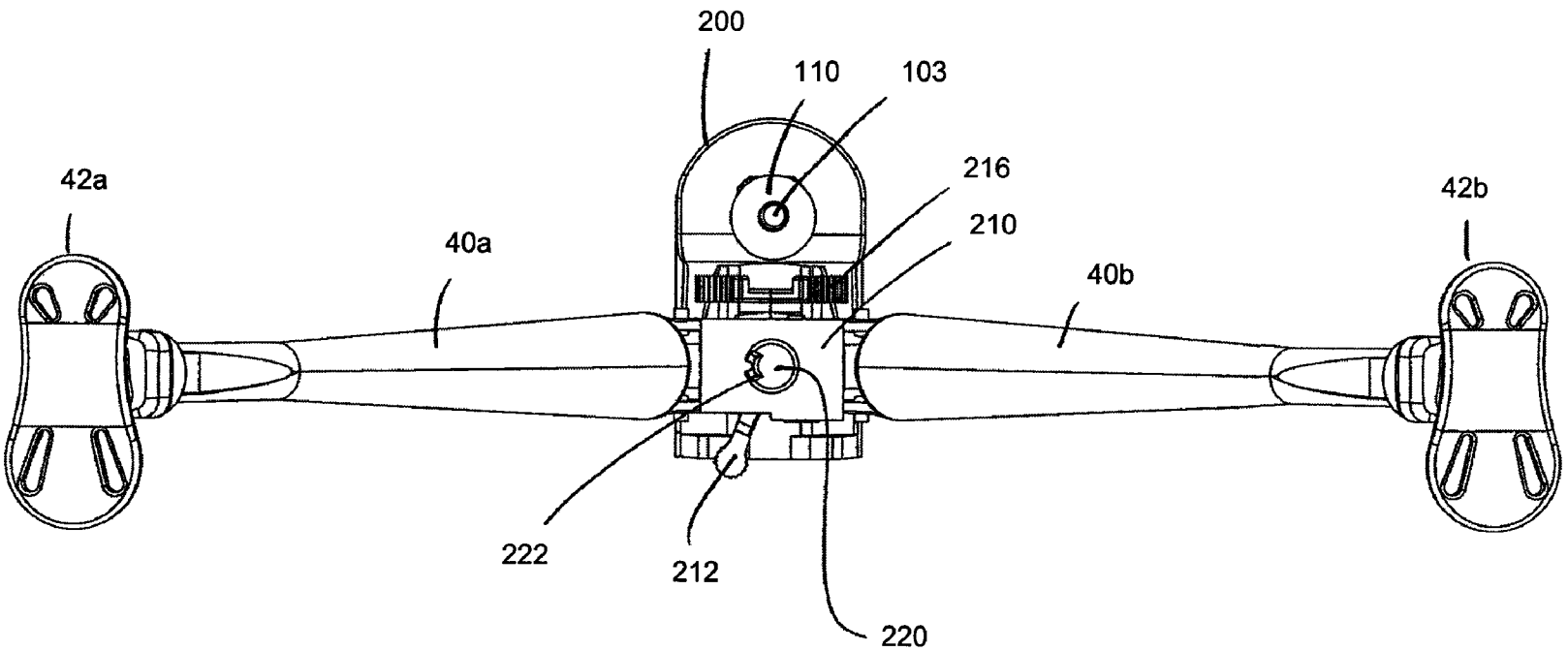
FIG. 6 schematic isometric bottom view of a bipod assembly for use supporting a firearm in accordance with one embodiment of the disclosure.
Figure 7:
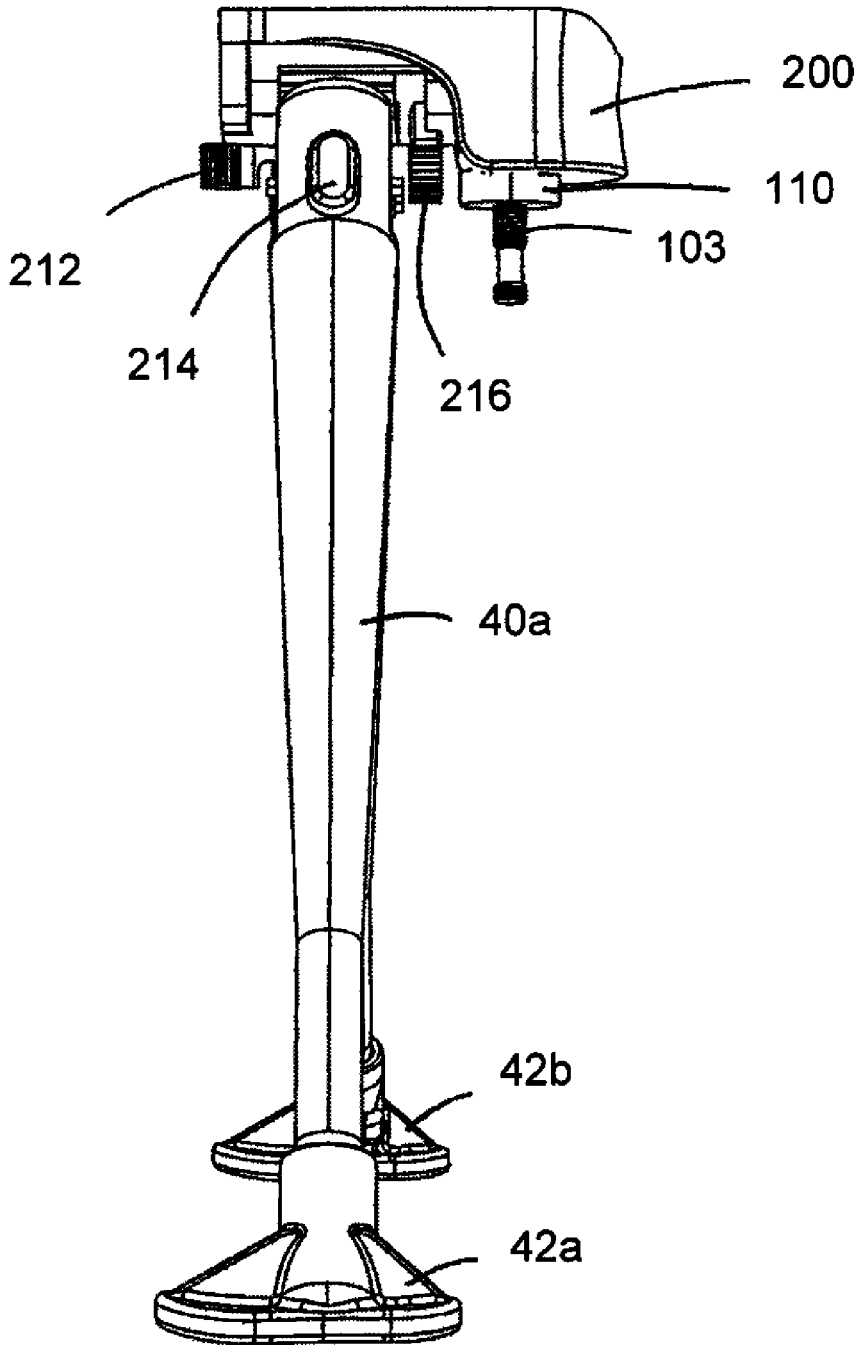
FIG. 7 is a schematic isometric side view of a bipod assembly for use supporting a firearm in accordance with one embodiment of the disclosure.
Figure 8:
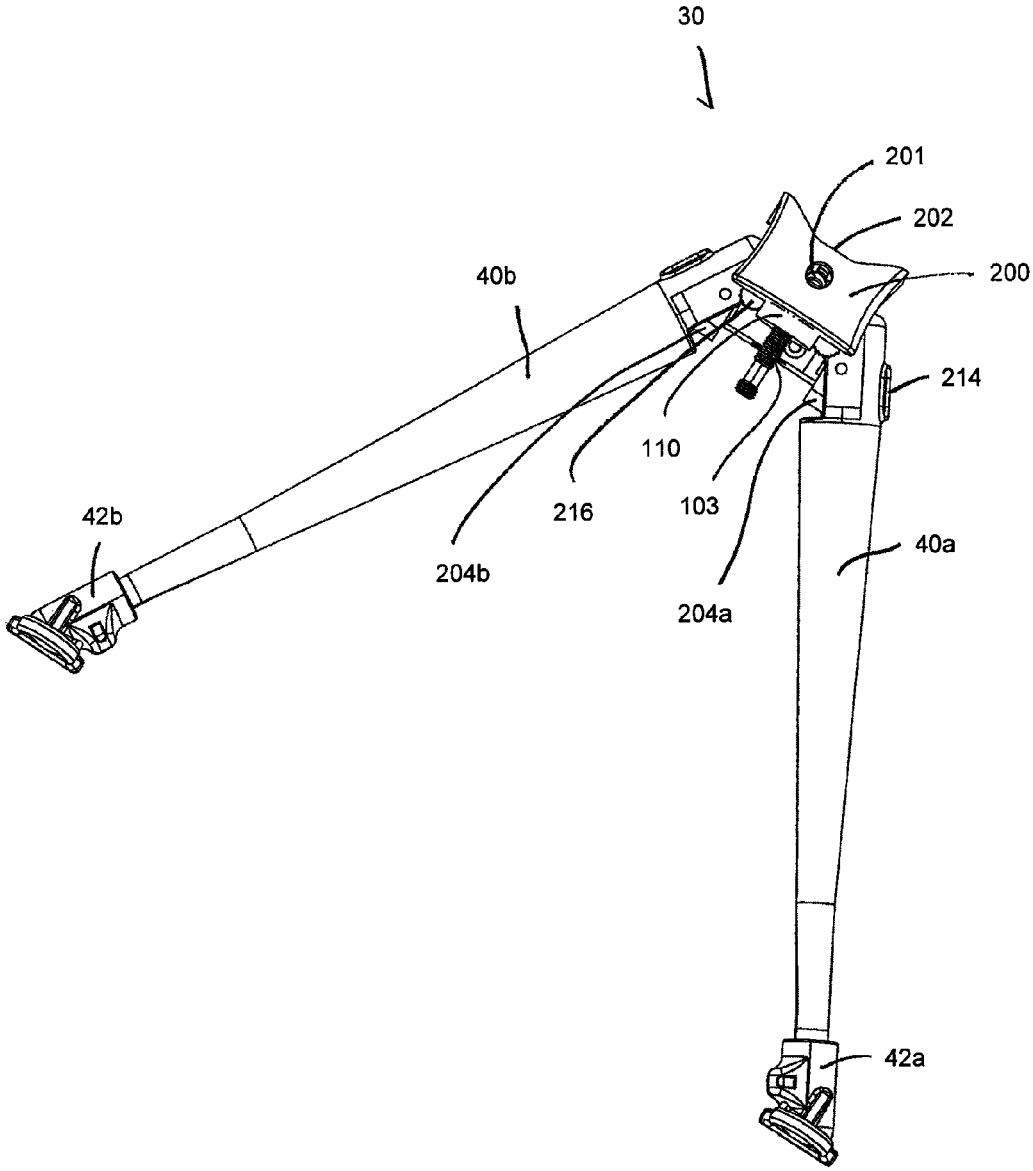
FIG. 8 is a schematic isometric rear view of a bipod assembly for use supporting a firearm in accordance with one embodiment of the disclosure.

FIG. 6 schematic isometric bottom view of a bipod assembly 5 for use supporting a firearm 10 in accordance with one embodiment of the disclosure. As shown in FIG. 6, the cant bushing 220 engages the pivot bushing 210 through aperture 222 in the pivot bushing 210. In operation, the pivot bushing 210 allows the adjustment assembly 30 to pivot about a first axis generally parallel with the stock 12 of the firearm 10, while the cant bushing 220 allows the adjustment assembly 30 (and hence the bipod assembly 5) to rotate about a second axis to provide movement transverse to the stock 12 of the firearm 10. FIGS. 7 and 8 are a schematic isometric side and rear views of the bipod assembly 5 for further illustrating the configuration of the components of the bipod assembly 5.

Figure 9:
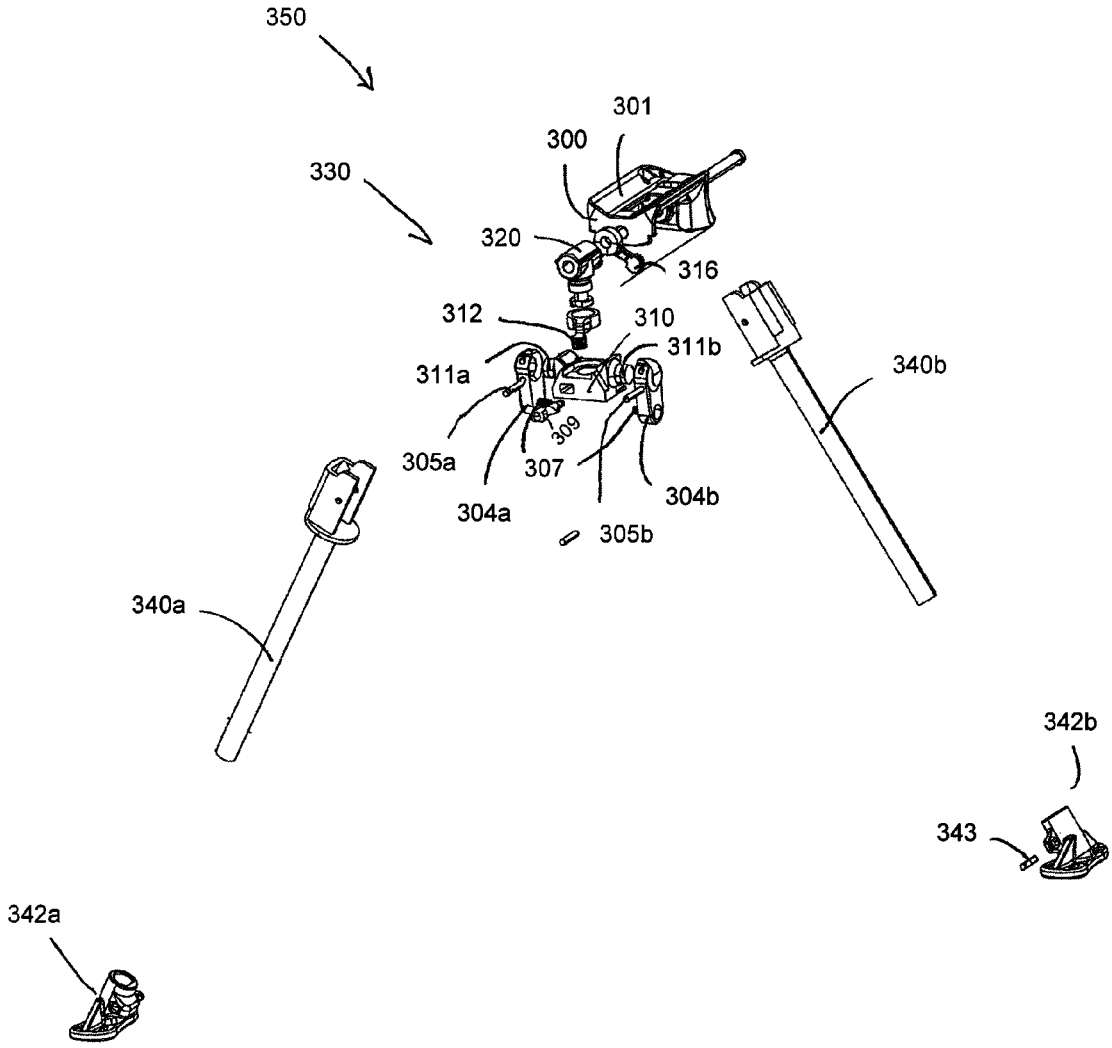
FIG. 9 is an exploded isometric front view of a bipod assembly for use supporting a firearm in accordance with one embodiment of the disclosure.

FIG. 9 is an exploded isometric front view of a bipod assembly for use supporting a firearm in accordance with one embodiment of the disclosure. As illustrated in FIG. 9, a bipod assembly 350 includes an adjustment assembly 330 having a stock mount bracket 300 having a surface 301 for reciprocally mating with a stock of a gun, a first cam lock 316 and a second cam lock 312, a cant bushing 320, a pivot bushing 310 having a first and a second ear 311*a*, 311*b* for engaging sleeves 304*a*, 604*b*. The sleeves 304*a*, 304*b* may be retained on the ears 311*a*, 311*b* of the pivot bushing with pins 305*a*, 305*b* or alternatively may be press fit on a flange of the ears 311*a*, 311*b*. The sleeves 304*a*, 304*b* further include tension springs 307 for pushing leg extensions 340*a*, 340*b* outward. The adjustment assembly 330 further includes a release pin 309 for engaging a plunger portion of the cant bushing and prevent the adjustment assembly 330 from moving in a first direction. The bipod assembly 350 further includes removable feet 342*a*, 342*b* releasably retained on the leg extensions 340*a*, 340*b*. A pin 343 may retain the feet 342*a*, 342*b* on the leg extensions 340*a*, 340*b*, alternatively, mechanical connections as are known in the art may be provided for releasably retaining the feet on the leg extensions. In still further embodiments, the feet are permanently affixed to the base of the leg extensions.

Figure 10:
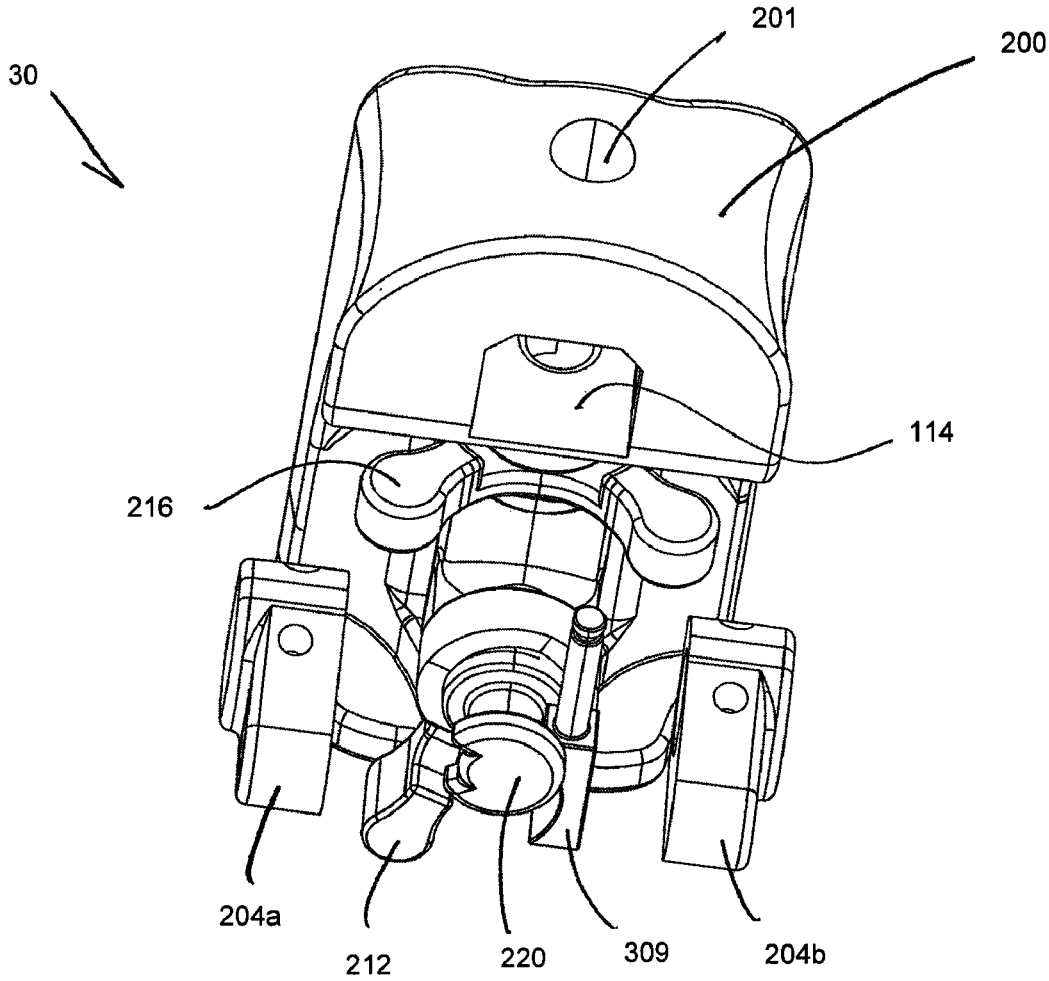
FIG. 10 is a schematic isometric underside view of an adjustment assembly of a bipod assembly for use supporting a firearm in accordance with one embodiment of the disclosure.
Figure 11:
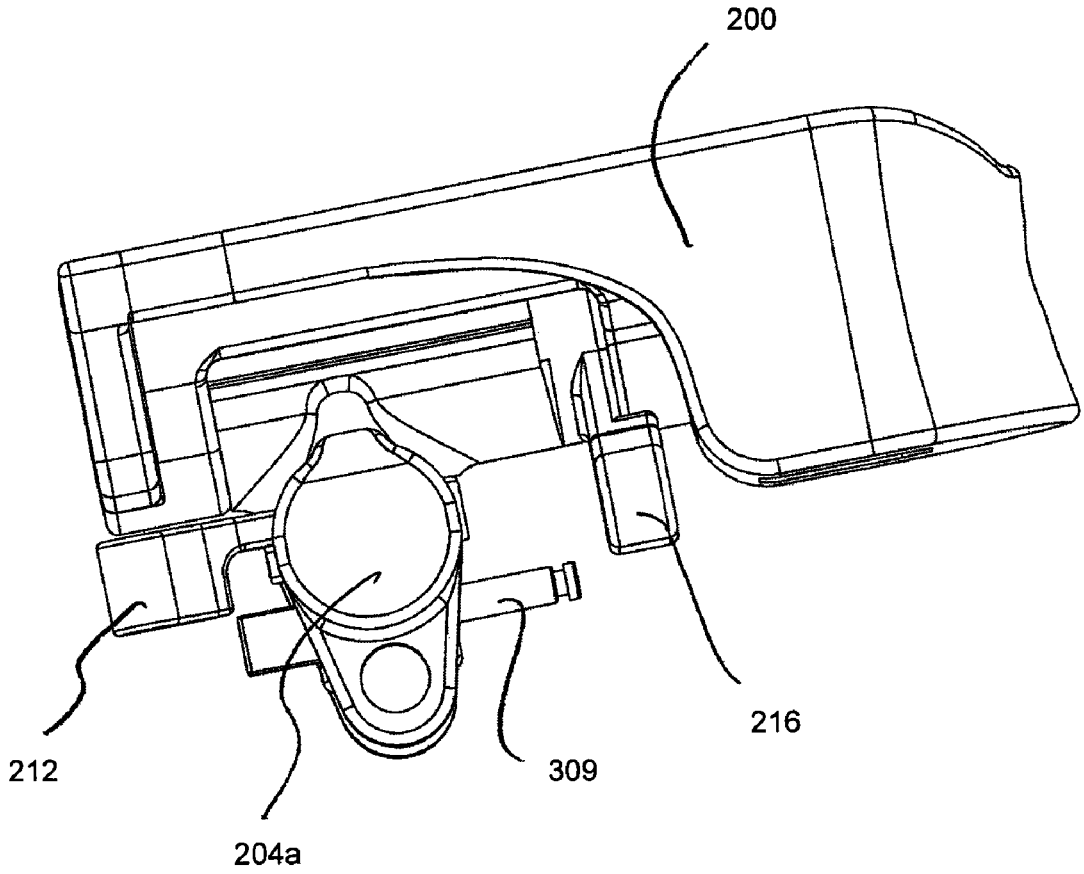
FIG. 11 is a schematic isometric side view of an adjustment assembly of a bipod assembly for use supporting a firearm in accordance with one embodiment of the disclosure.
Figure 12:
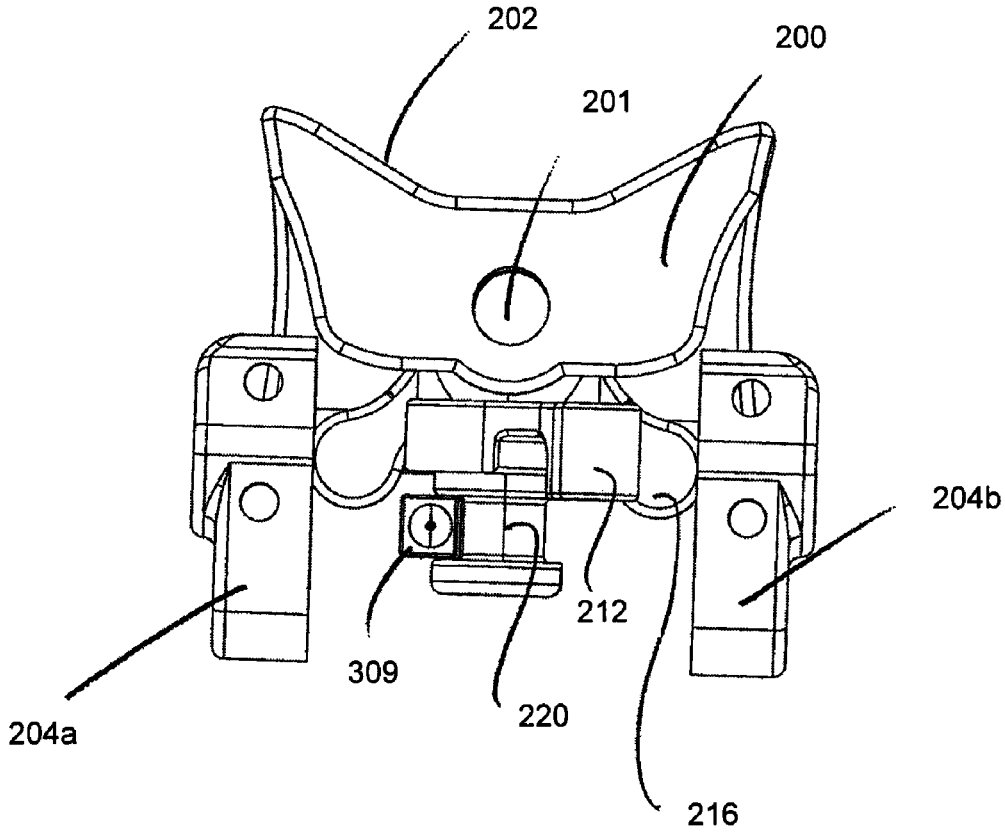
FIG. 12 is a schematic isometric front view of an adjustment assembly of a bipod assembly for use supporting a firearm in accordance with one embodiment of the disclosure.
Figure 13:
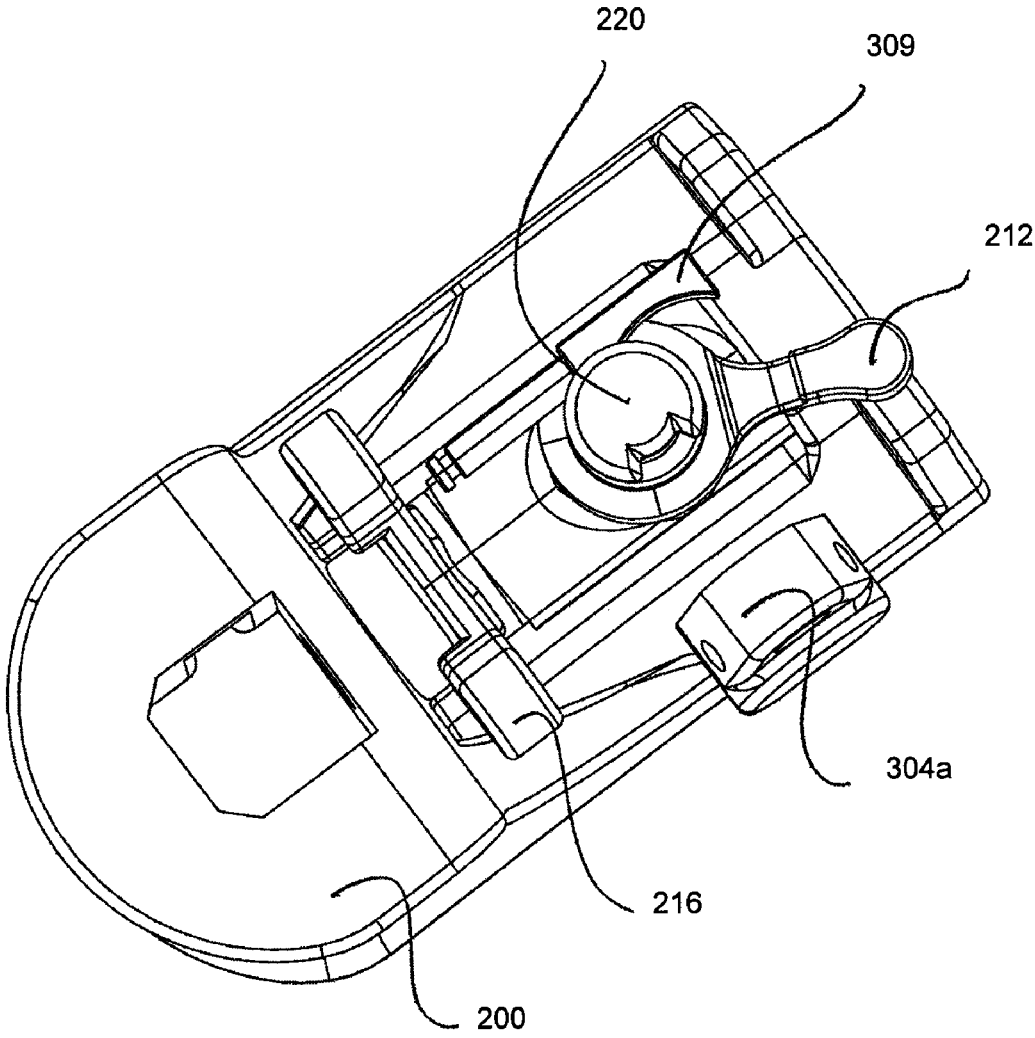
FIG. 13 is a schematic isometric bottom view of a partial adjustment assembly of a bipod assembly for use supporting a firearm in accordance with one embodiment of the disclosure.

FIG. 10 is a schematic isometric underside view of an adjustment assembly 30 of a bipod assembly 5 for use supporting a firearm 10 in accordance with one embodiment of the disclosure. As further shown in FIG. 10, the adjustment assembly includes a stock mount bracket 200 having a first aperture 201 for receiving a pivot pin (not shown for clarity) and a second aperture 114 for receiving an attachment assembly (not shown for clarity), a first cam lock 216 and a second cam lock 212 engaged with a cant bushing 220, a release pin 309 engagable with a plunger portion of the cant bushing 220. Also shown are the sleeves 204*a*, 204*b*. The pivot bushing is removed from FIG. 10 to more clearly shown the interrelationship of the other adjustment assembly components. FIG. 11 is a schematic isometric side view of the adjustment assembly of FIG. 10. FIG. 12 is a schematic isometric front view of the adjustment assembly of FIG. 10. FIG. 13 is a schematic isometric bottom view of a partial adjustment assembly of FIG. 10 wherein sleeve 304*b* is removed from view.

Figure 14:
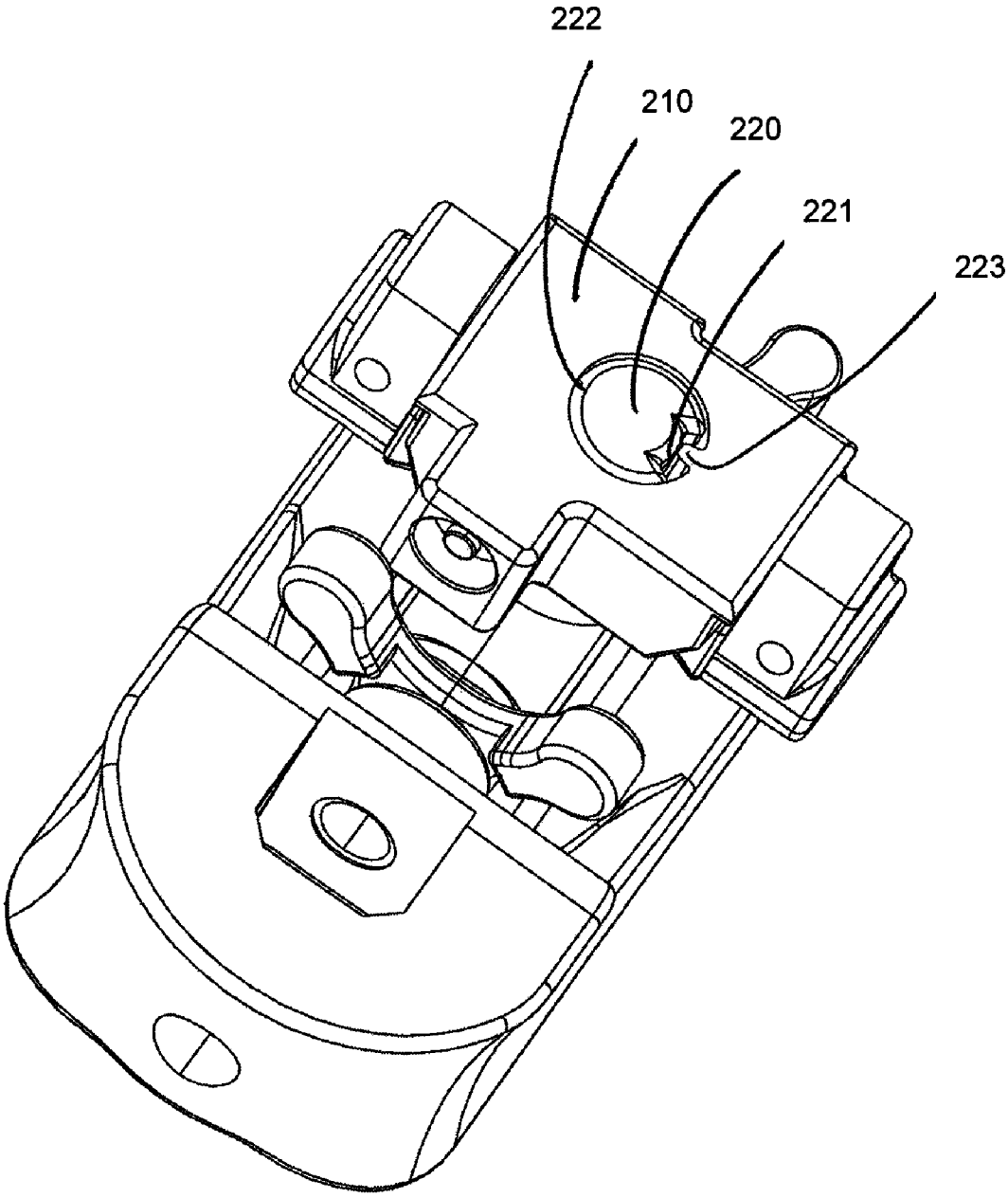
FIG. 14 is a schematic isometric bottom view of an adjustment assembly of a bipod assembly for use supporting a firearm in accordance with one embodiment of the disclosure.

FIG. 14 is a schematic isometric bottom view of an adjustment assembly of a bipod assembly for use supporting a firearm in accordance with one embodiment of the disclosure. FIG. 14 is similar to FIGS. 10-13 except FIG. 14 further includes the pivot bushing 230. As shown in FIG. 14, the pivot bushing 210 has aperture 222 for receiving a plunger portion of cant bushing 220. The pivot bushing further includes a groove 223 in the aperture to engage a notch 221 in the plunger portion of the cant bushing 220 to restrict movement.

Figure 15:
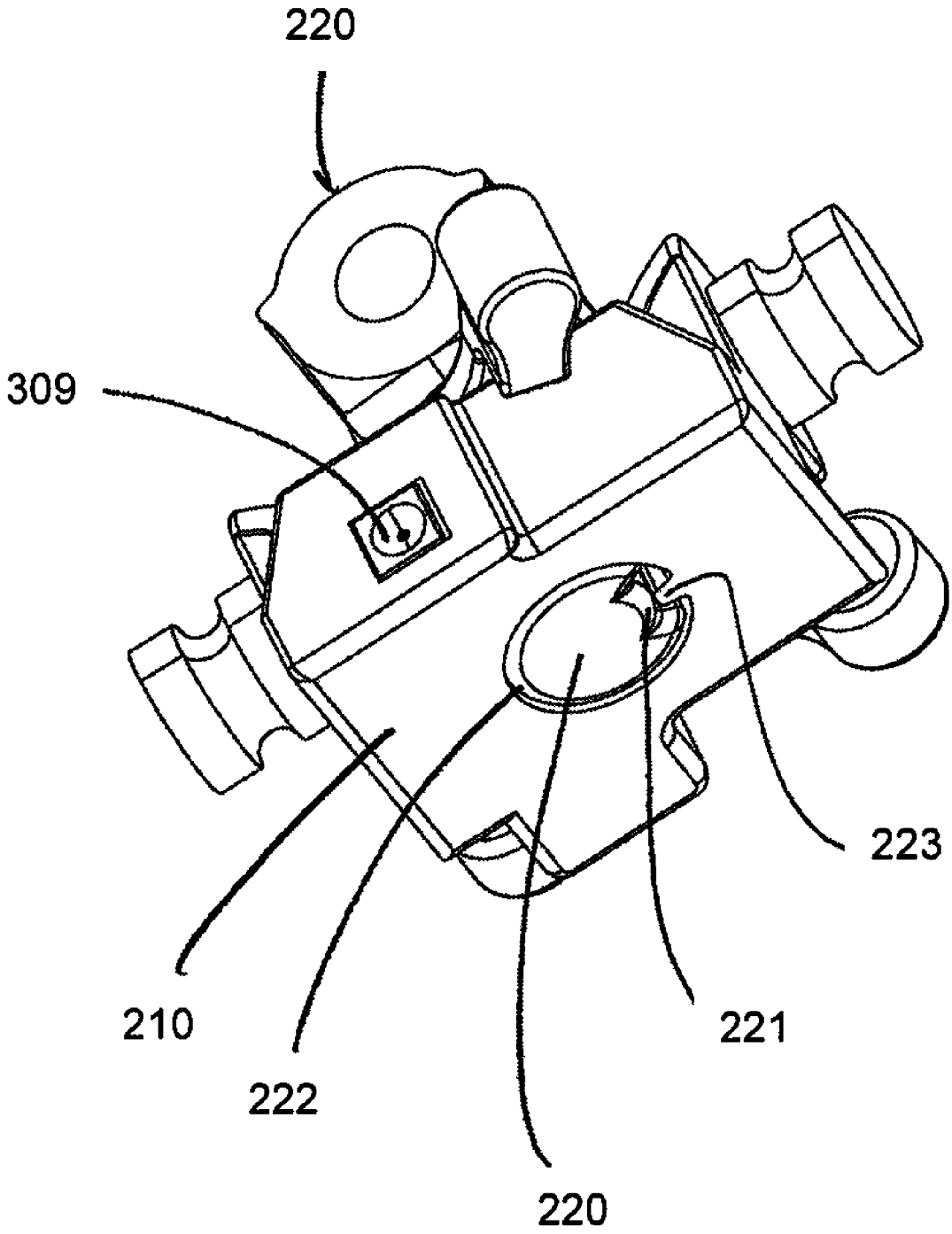
FIG. 15 is a schematic isometric bottom view of a partial adjustment assembly of a bipod assembly for use supporting a firearm in accordance with one embodiment of the disclosure.
Figure 16:
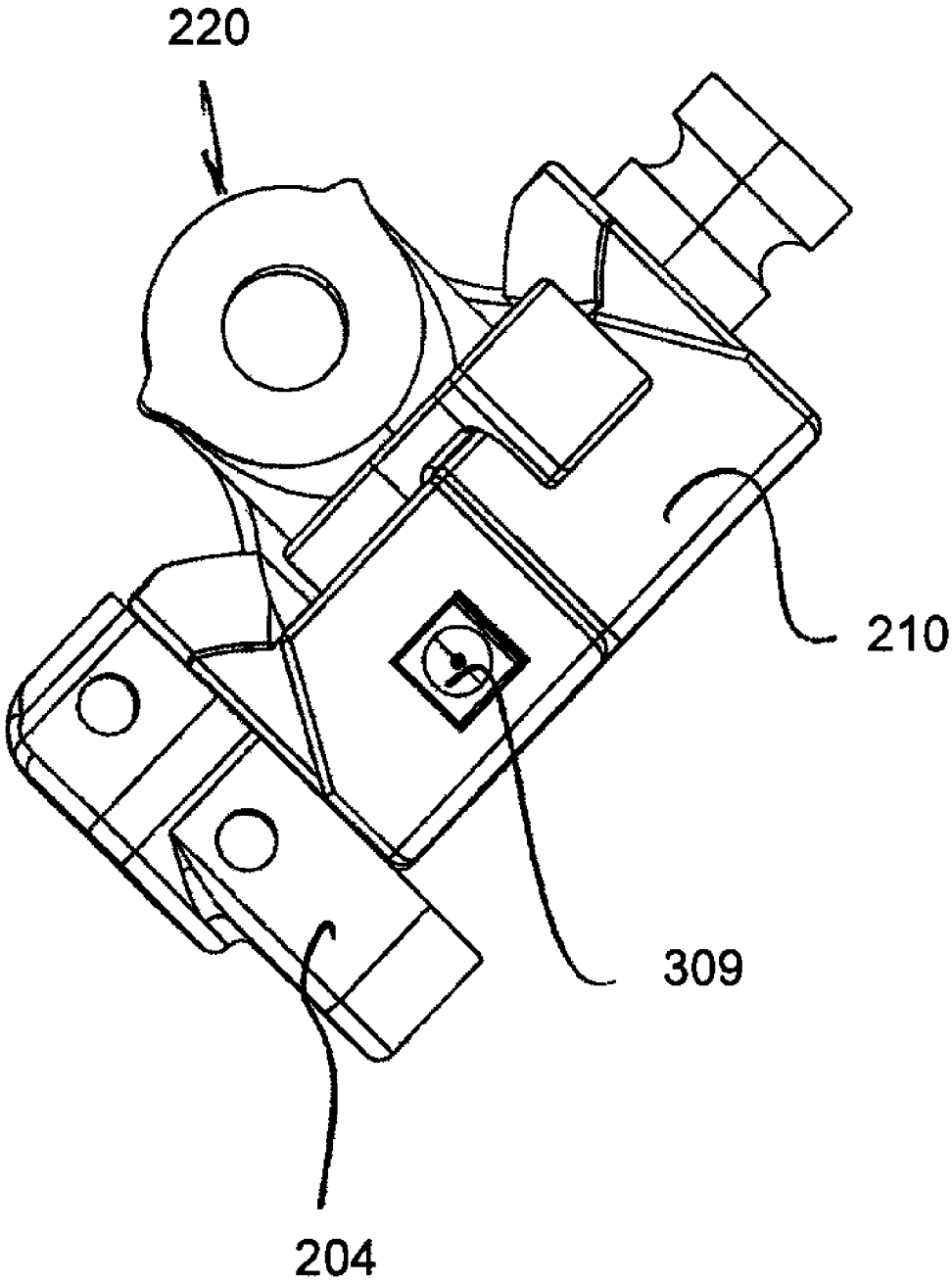
FIG. 16 is a schematic isometric side view of a partial adjustment assembly of a bipod assembly for use supporting a firearm in accordance with one embodiment of the disclosure.

FIG. 15 is a schematic isometric bottom view of a partial adjustment assembly 20 of FIG. 14 with the stock mount bracket removed to further illustrate the relationship between the elements of the adjustment assembly 20. FIG. 16 is a schematic isometric side view of a partial adjustment assembly 20.

Figure 17:
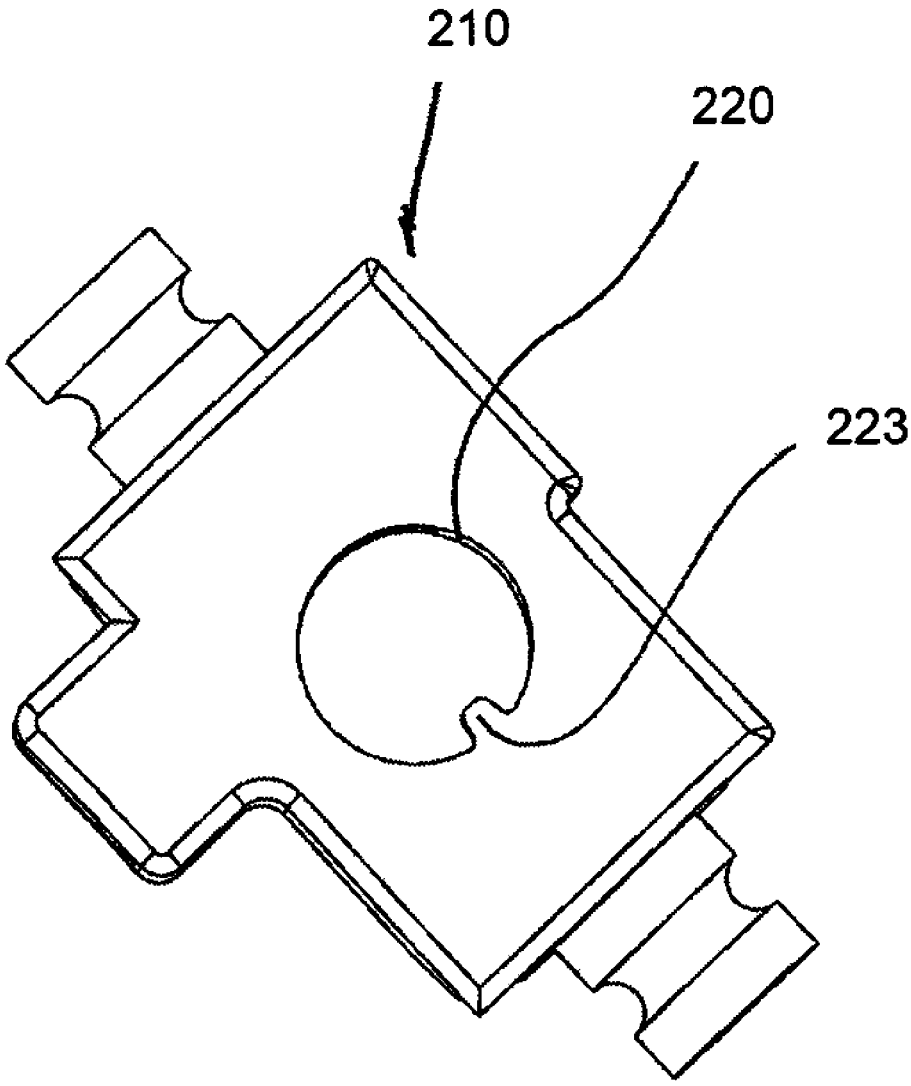
FIG. 17 is a schematic isometric underside view of a pivot bushing of a bipod assembly for use supporting a firearm in accordance with one embodiment of the disclosure.
Figure 18:
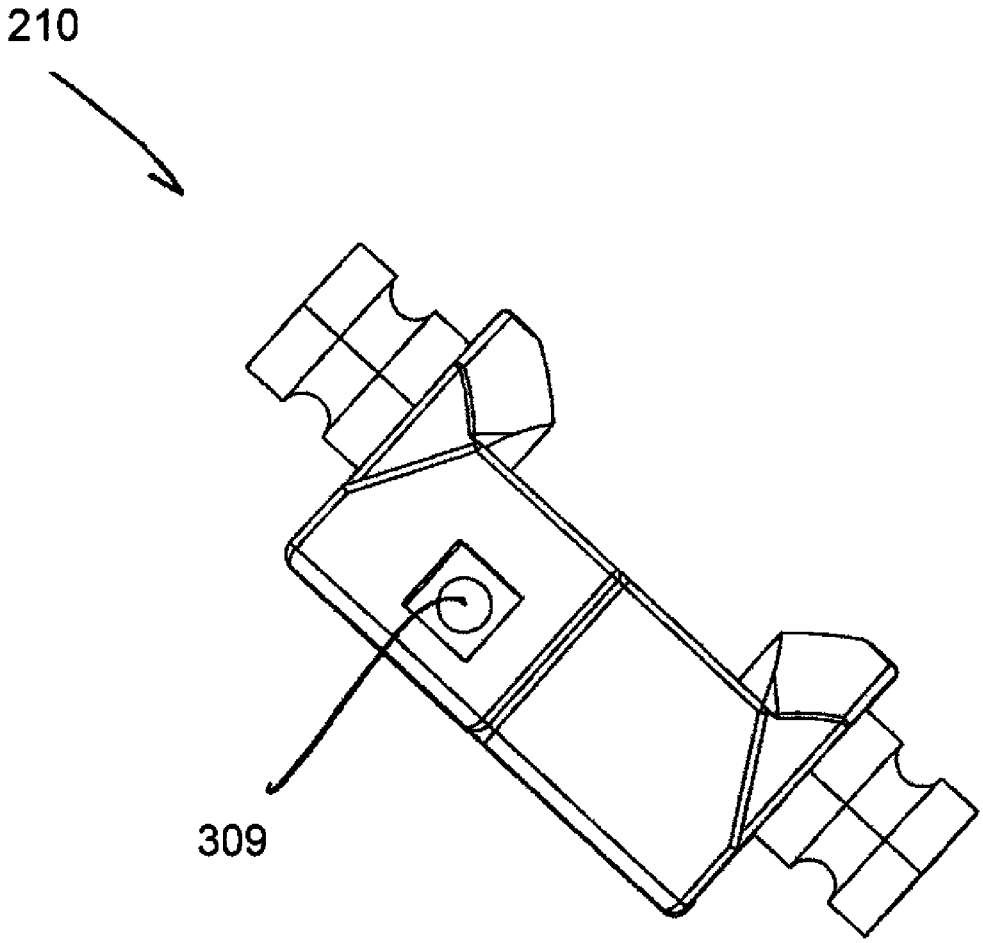
FIG. 18 is a schematic isometric right side view of a pivot bushing of a bipod assembly for use supporting a firearm in accordance with one embodiment of the disclosure.
Figure 19:
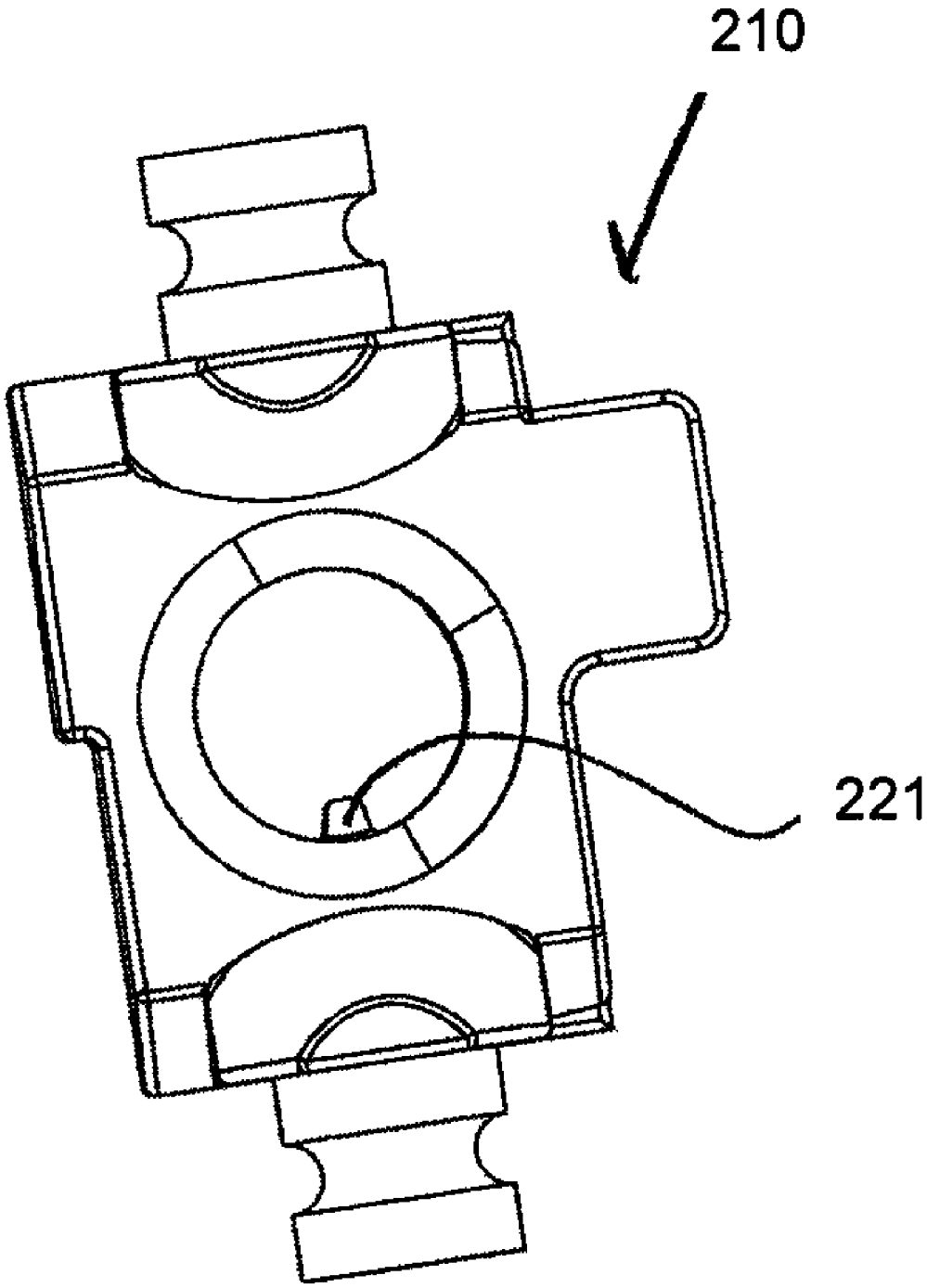
FIG. 19 is a schematic isometric top view of a pivot bushing of a bipod assembly for use supporting a firearm in accordance with one embodiment of the disclosure.
Figure 20:
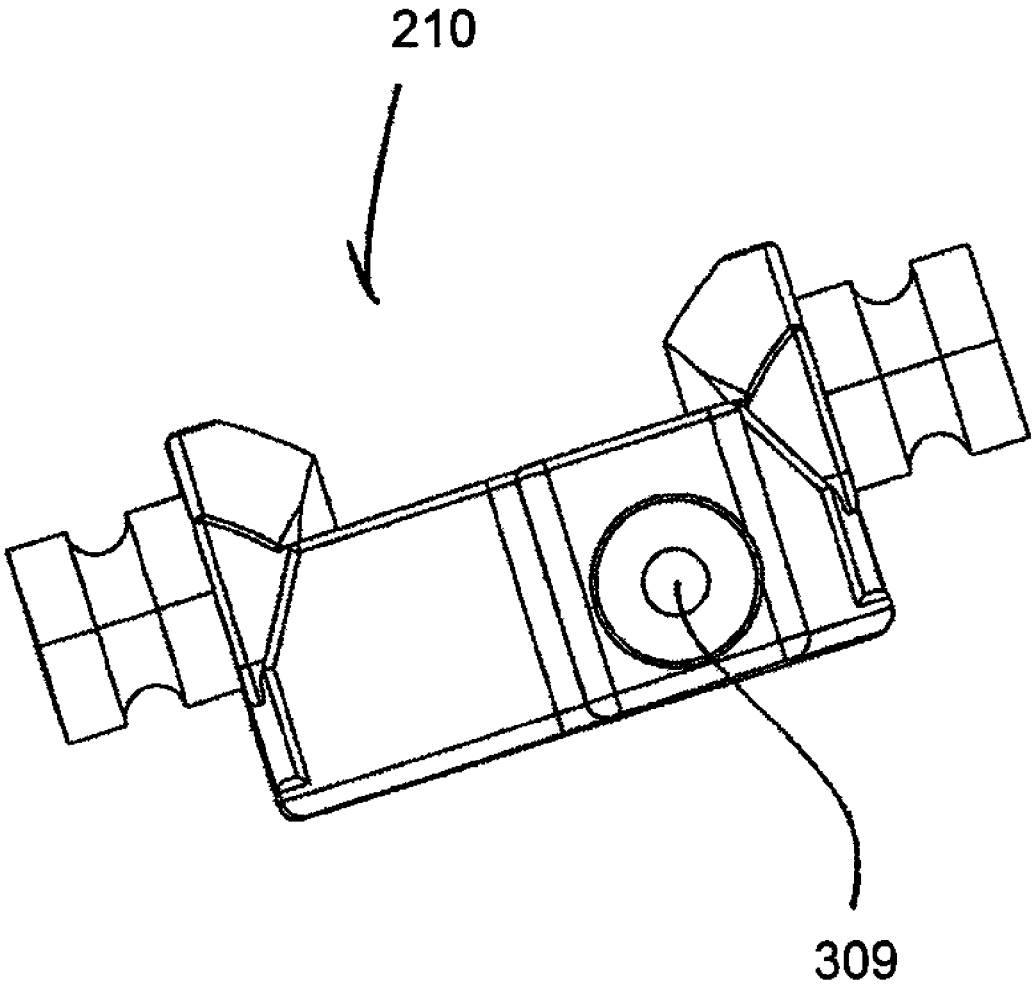
FIG. 20 is a schematic isometric left side view of a pivot bushing of a bipod assembly for use supporting a firearm in accordance with one embodiment of the disclosure.

FIG. 17 is a schematic isometric underside view of a pivot bushing 210 of a bipod assembly 5 for use supporting a firearm in accordance with one embodiment of the disclosure. FIG. 18 is a schematic isometric right side view of the pivot bushing 210 of FIG. 17. FIG. 19 is a schematic isometric top view of the pivot bushing 210 of FIG. 17. FIG. 20 is a schematic isometric left side view of the pivot bushing 210 of FIG. 17.

Figure 21:
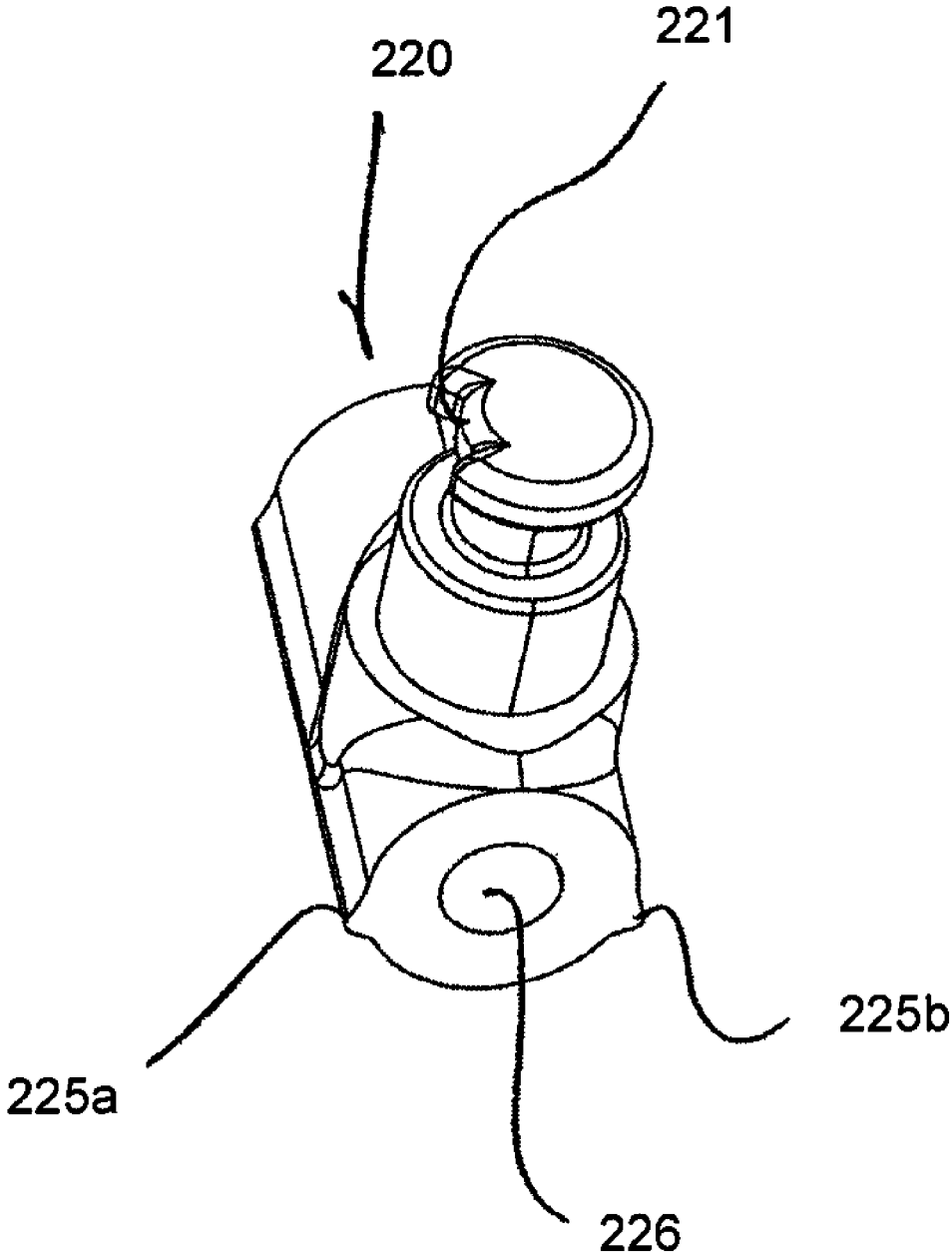
FIG. 21 is a schematic isometric top view of a cant bushing of a bipod assembly for use supporting a firearm in accordance with one embodiment of the disclosure.

FIG. 21 is a schematic isometric top view of a cant bushing 220 of a bipod assembly for use supporting a firearm in accordance with one embodiment of the disclosure. The cant bushing 220 includes protrusions 225*a*, 225*b* for restricting rotation by engaging the adjustment assembly when fully assembled. The cant bushing 220 further includes an aperture 226 for receiving the pivot pin shown and described above.

Figure 22:
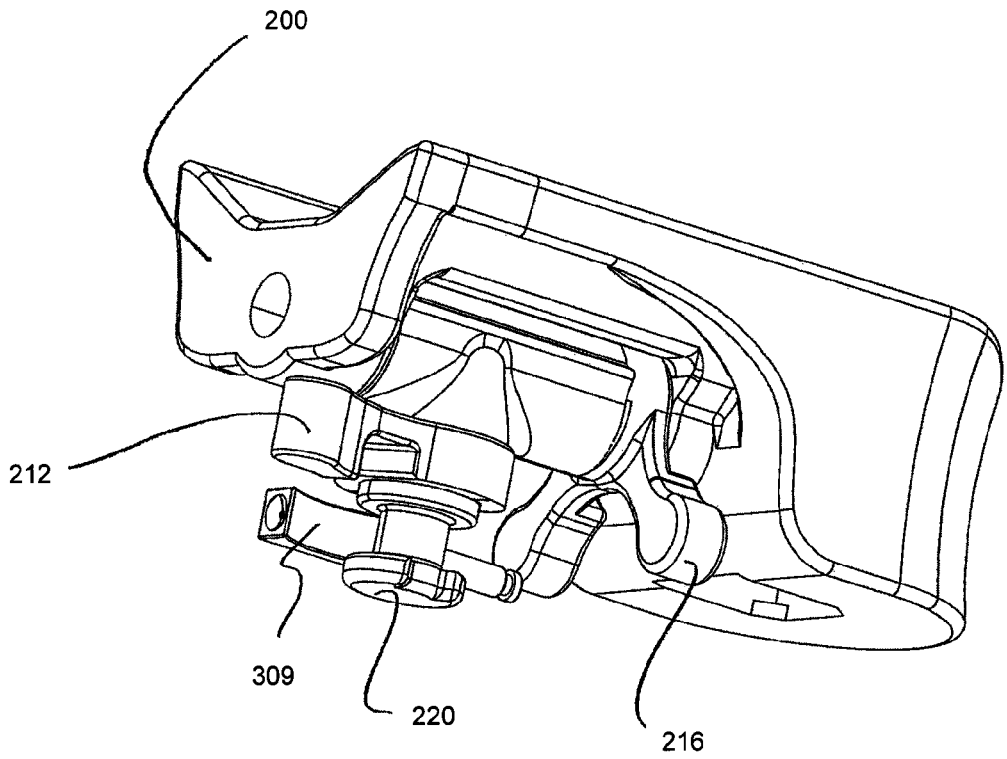
FIG. 22 is a schematic isometric front side view of a partial adjustment assembly of a bipod assembly for use supporting a firearm in accordance with one embodiment of the disclosure.
Figure 23:
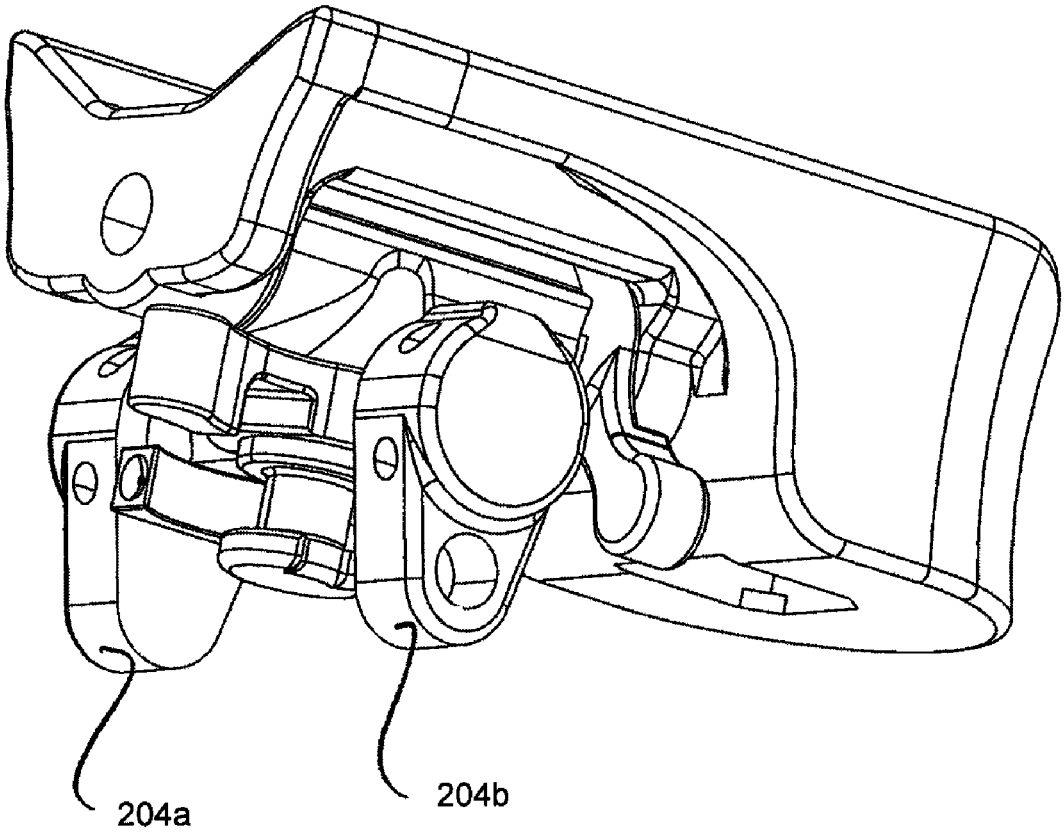
FIG. 23 is a schematic isometric front side view of a partial adjustment assembly of a bipod assembly for use supporting a firearm in accordance with one embodiment of the disclosure.
Figure 24:
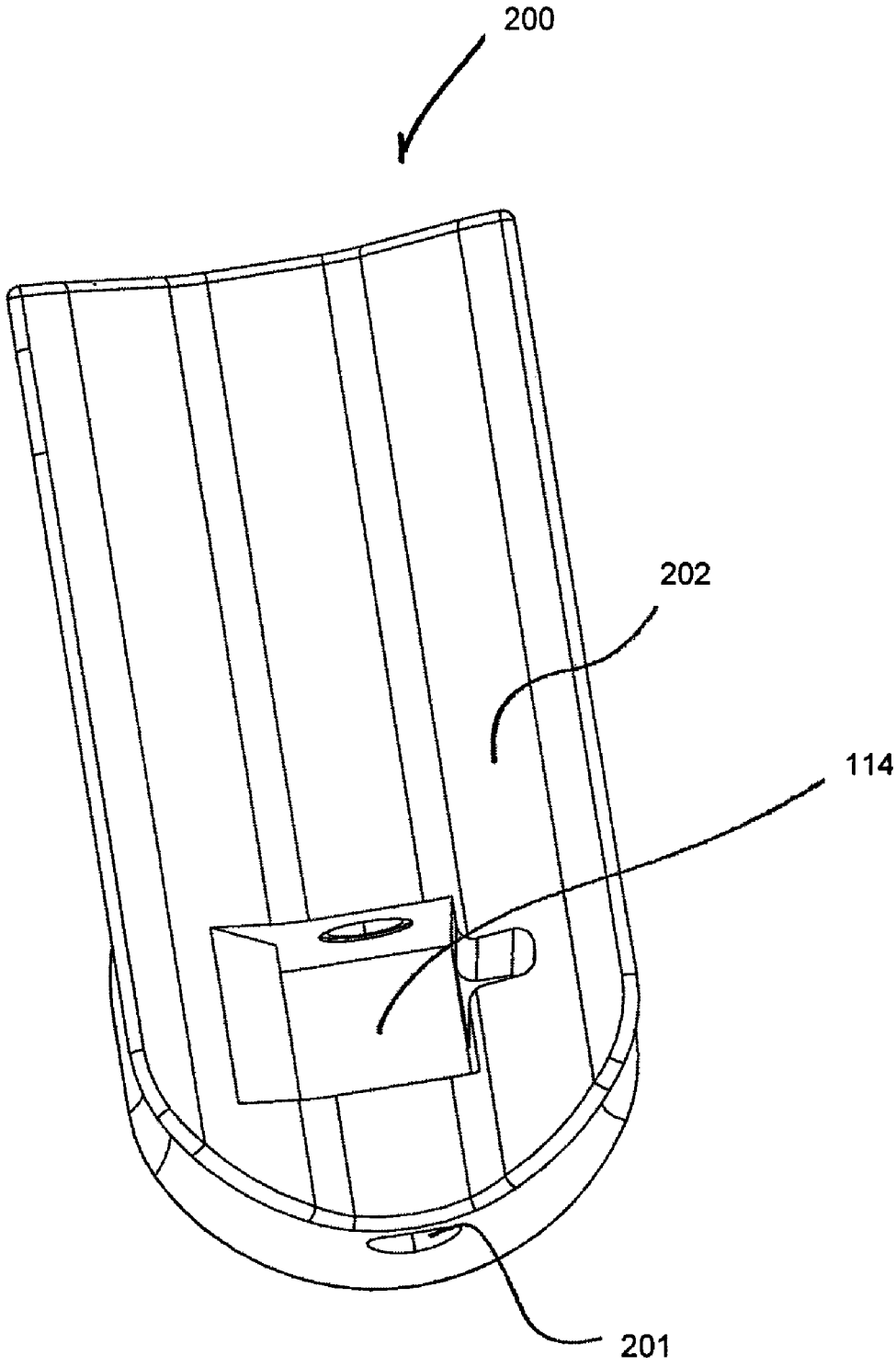
FIG. 24 is a schematic isometric top view of a stock mount bracket of a bipod assembly for use supporting a firearm in accordance with one embodiment of the disclosure.
Figure 25:
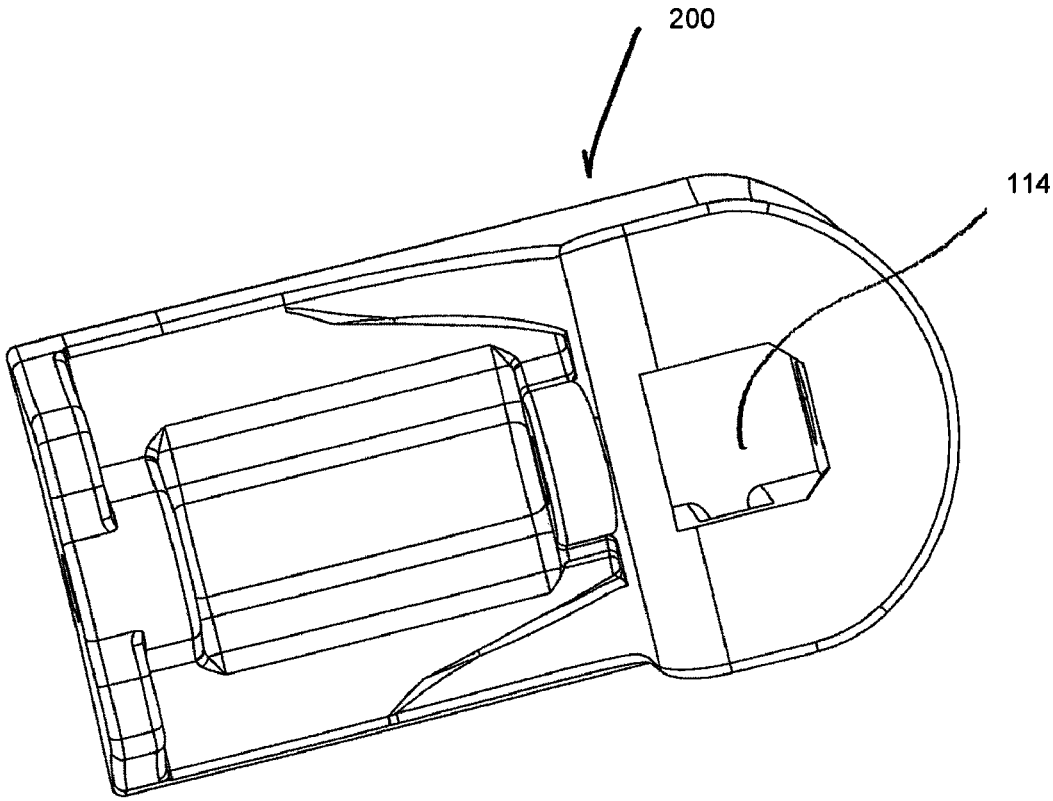
FIG. 25 is a schematic isometric bottom view of a stock mount bracket of a bipod assembly for use supporting a firearm in accordance with one embodiment of the disclosure.
Figure 26:
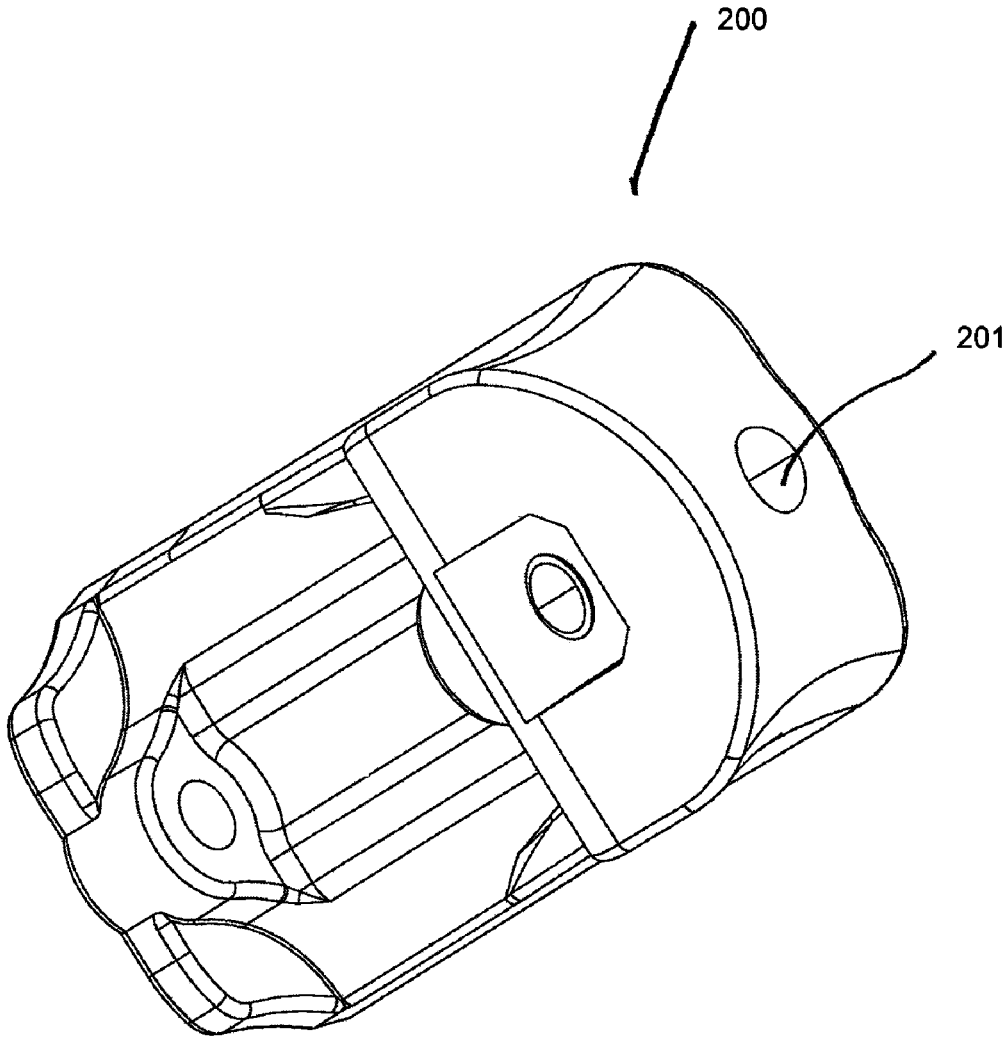
FIG. 26 is a schematic isometric bottom side view of a stock mount bracket of a bipod assembly for use supporting a firearm in accordance with one embodiment of the disclosure.
Figure 27:
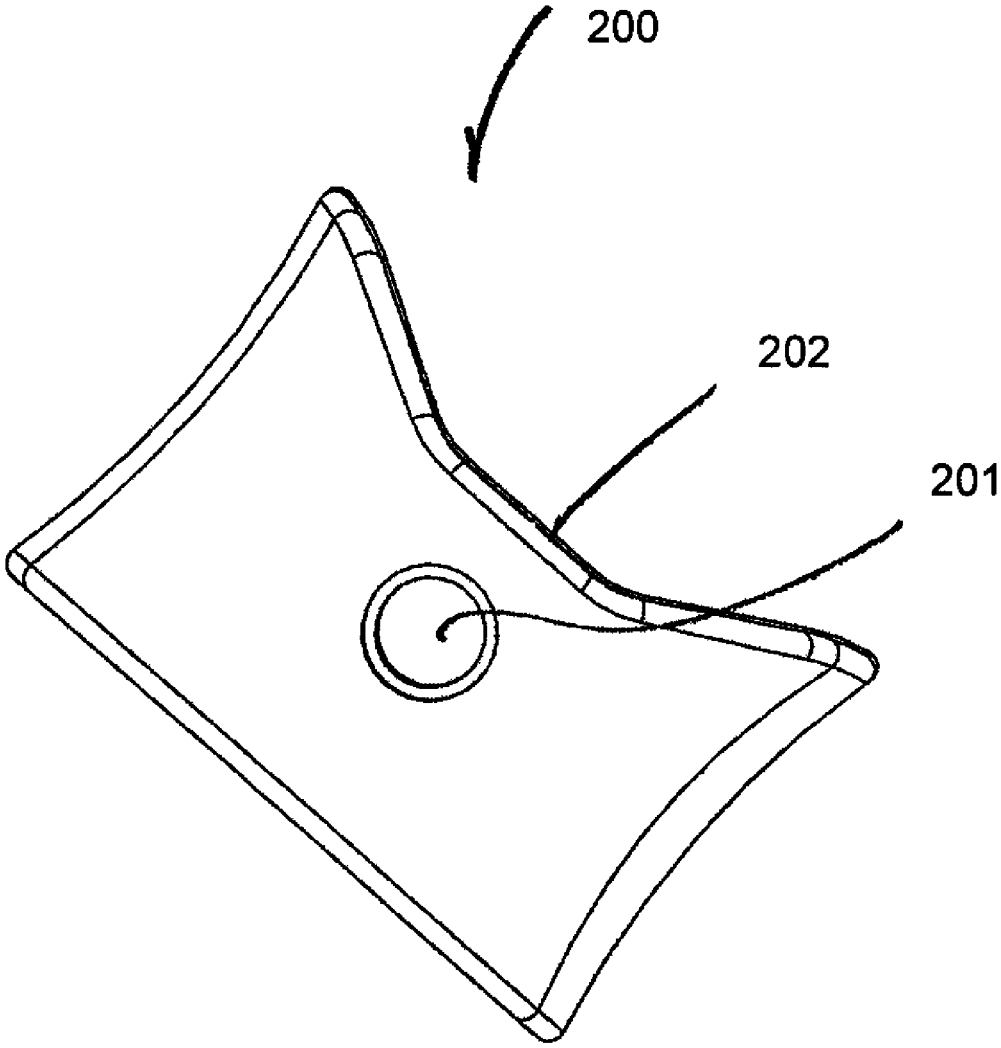
FIG. 27 is a schematic isometric front view of a stock mount bracket of a bipod assembly for use supporting a firearm in accordance with one embodiment of the disclosure.

FIGS. 22 and 23 are schematic isometric front side views of a partial adjustment assembly of a bipod assembly for use supporting a firearm in accordance with embodiments of the disclosure.

FIGS. 24-27 are schematic isometric views of a stock mount bracket of a bipod assembly for use supporting a firearm in accordance with embodiments of the disclosure.

Figure 28:
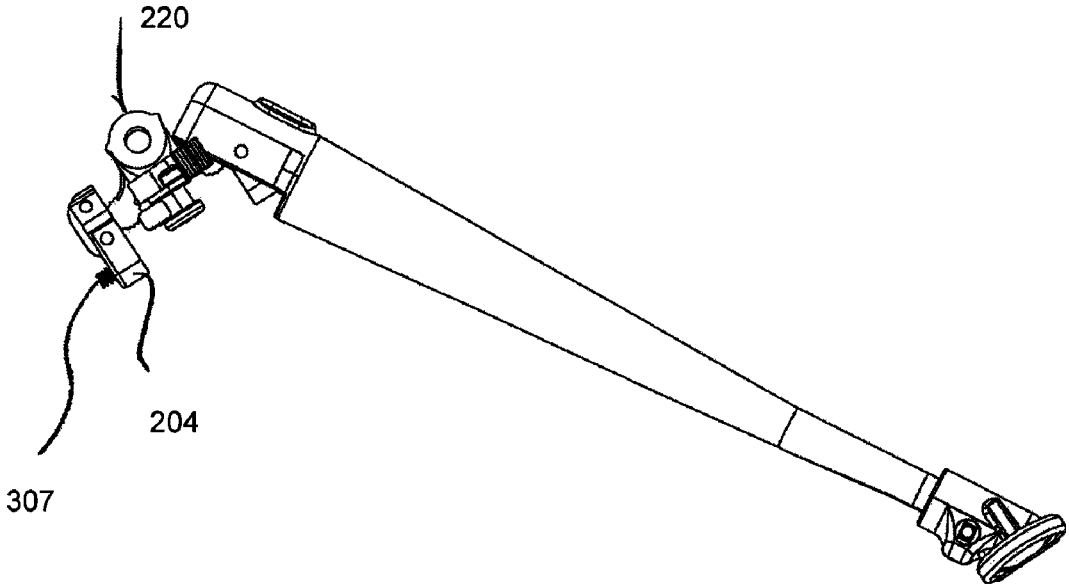
FIG. 28 is a schematic isometric front side view of a partial bipod assembly for use supporting a firearm in accordance with one embodiment of the disclosure.
Figure 29:
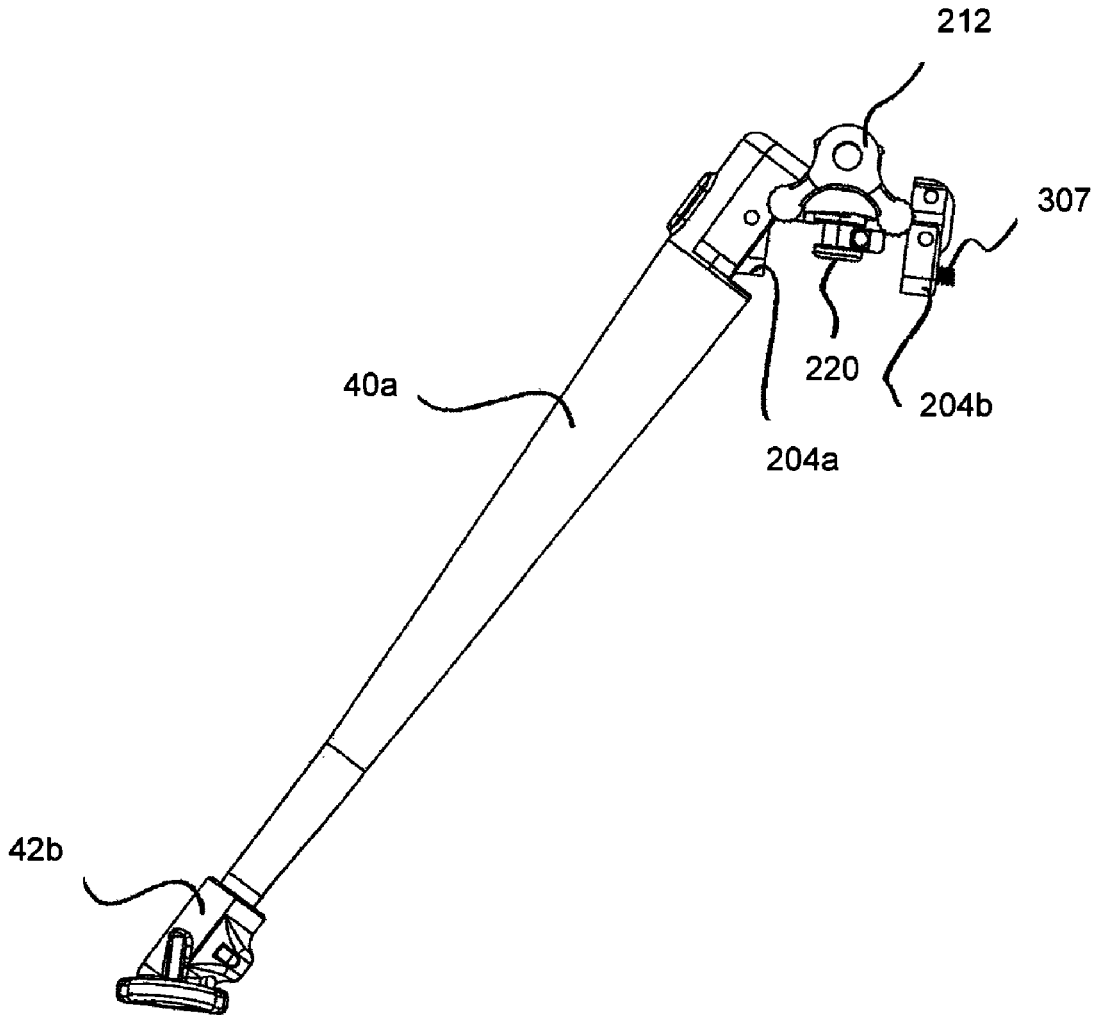
FIG. 29 is a schematic isometric back side view of a partial bipod assembly for use supporting a firearm in accordance with one embodiment of the disclosure.

FIGS. 28 and 29 are schematic isometric views of a partial bipod assembly for use supporting a firearm in accordance with one embodiment of the disclosure.

Figure 30:
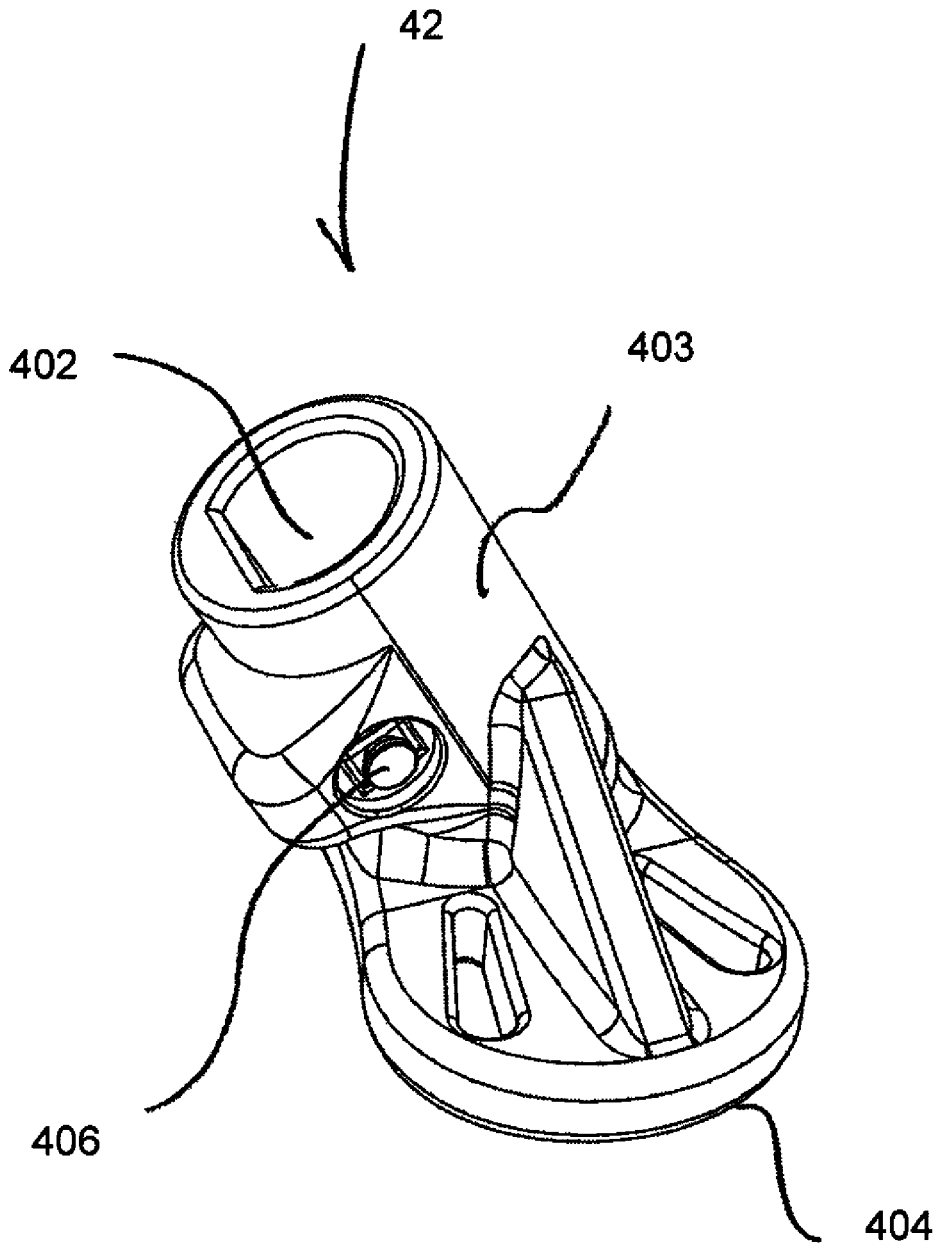
FIG. 30 is a schematic isometric front side view of a removable foot of a bipod assembly for use supporting a firearm in accordance with one embodiment of the disclosure.
Figure 31:
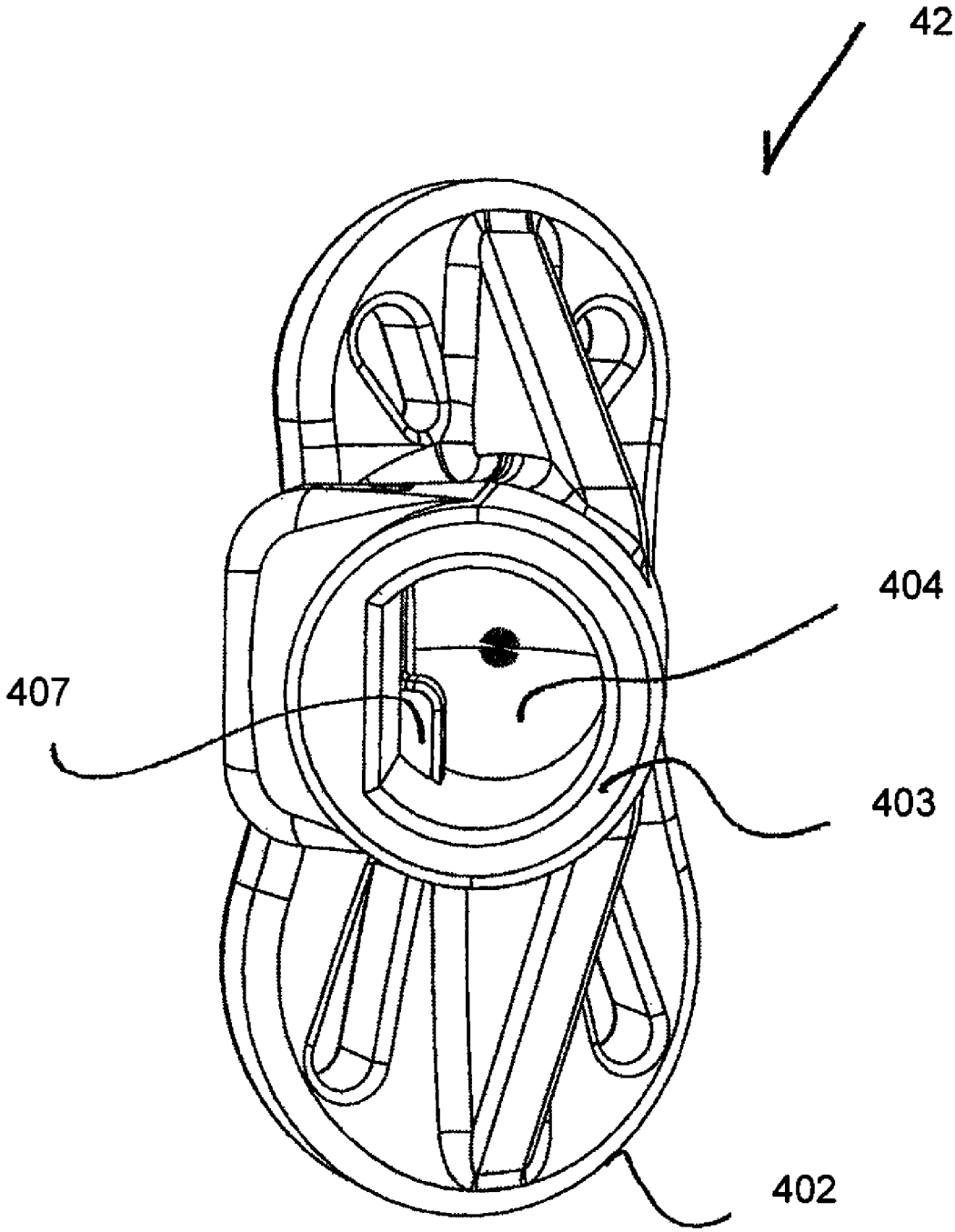
FIG. 31 is a schematic isometric top side view of a removable foot of a bipod assembly for use supporting a firearm in accordance with one embodiment of the disclosure.

FIG. 30 is a schematic isometric front side view of a removable foot of a bipod assembly for use supporting a firearm in accordance with one embodiment of the disclosure. FIG. 31 is a schematic isometric top side view of the removable foot of FIG. 30. The removable foot 42 includes a sleeve 403 for receiving a leg extension (not shown) in an interior receiving space 402 therein, a contact surface 404 for contacting the ground and supporting the bipod assembly, and a release mechanism 406 for removeably releasing the foot 42 from the leg extension. As can be appreciated by those skilled in the art, a variety of mechanical coupling mechanisms may be used to retain the foot on the leg extension, including but not limited to friction fit, spring loaded pins, reciprocal snap fit indents and detents, locking mechanisms, and the like.

C. Further Bipod Features

In one embodiment, a bipod includes one or more of the following features:

- A stock mount,
- A piece with one or more contact surfaces that contact the forend of a stock
  - In one embodiment, contact surfaces are manufactured from non-marring material(s)
  - In another embodiment, contact surfaces are covered with a layer of non-marring material
- The stock mount may contain a rounded surface that fits in the web between a human thumb and forefinger
- A mechanism for removably attaching the bipod to a swivel stud on a stock
- In one embodiment, the mechanism is divided into five or more components, including:
  - A threaded shaft with a protrusion on one end that engages holes in a stock swivel stud
  - A piece that contains a protrusion that engages the hole in a stock swivel stud and removably attaches to the first component
  - A compression spring that urges these two pieces apart
  - A nut that threads onto the threaded portion of the first component
  - A tapered cavity in the stock mount
  - Advancing the threaded nut on the threaded portion of the first component causes the first two components to be pulled into the tapered cavity in the stock mount, which forces the two component halves together to capture the swivel stud on the stock
- A mechanism that allows for the independent adjustment of "pivot" and "cant"
- Pivot and cant motions are each made independently, so that either motion can be adjusted without impacting the other
  - The tension against which pivot and cant adjustments are made can be adjusted
    - The adjustments cover a range from zero tension to tension sufficient to prohibit motion
    - The adjustments can be made without tools in several applications
    - The adjustment surfaces may be loaded by compression springs to assist with tension maintenance
    - In one embodiment, the adjustments may be made on progressive cam surfaces
    - In one embodiment, the adjustments are made using levers; in other embodiments, the adjustments may be made using thumbwheels or similar adjusting mechanisms that can apply force and do not require the use of tools
  - The range of cant can be limited
    - In one embodiment, the range of cant adjustment is limited by protrusions on the cant round
    - In another embodiment, the range of can adjustment is limited by protrusions on the stock mount
    - In another embodiment, the range of cant adjustment is limited by protrusions on the outer leg housings
  - The range of pivot may be limited
    - In one embodiment, the range of pivot adjustment is limited by protrusions on the cant round
    - In another embodiment, the range of pivot adjustment is limited by protrusions on the stock mount
- Stock mount bushing
  - A mechanism that
    - Contains surface geometries that act against geometries on the outer housings and/or spring sleeves that serve to indicate the outer housing in a predetermined position
    - Is removably attached to the stock mount assembly or the cant round
      - The stock mount bushing may be attached and located with a removable pin that is held in a detent notch in the stock mount bushing and also simultaneously held in a detent notch in the stock mount cant round by spring pressure. Bringing force against the pin overcomes the spring pressure and moves the pin out of its home detent, thereby allowing the stock mount bushing to be removed with a sharp point (e.g. the point of a bullet) rather than a specialized tool (e.g. a screwdriver); or A stock mount bushing that is removably attached to the cant round and is indicated in place with a fastener (the fastener could be a roll pin, a screw, or other fastener) that transverses one axis of the stock mount bushing as well as one axis of the cant round, thereby attaching the stock mount bushing to the cant round and indicating it in position Two "legs"

Each leg consists of one or more "outer housings," one or more "leg extensions," and one or more "leg extension controls."

outer housing(s)

mates with surface geometries on the stock mount or the stock mount pivot bushing that serve to indicate the outer housings in predetermined positions may be formed in a plurality of pieces and removably or non-removably (e.g., permanently) attached to each other the outer housings are urged apart by compression springs In one embodiment, the compression springs that are captured in individual spring sleeves are removably attached to the outer housings In another embodiment, the compression springs are captured in the stock mount bushing In another embodiment, the outer housings are acted against by springs housed in the stock mount At least a portion of which are generally hollow and designed to receive at least a portion of the leg extensions The geometry of the outer housings may or may not be manufactured using extrusion In one embodiment, the outer housing has a taper from one end to the other In another embodiment, the outer housing is non-symmetrical along some portion of its length In another embodiment, the outer housing has a first cross-section shape at a first section and a second cross-sectional shape at a second section axially spaced apart from the first section In another embodiment, the outer housing defines an axis and includes a cross-sectional shape taken along a plane transverse to the axis. The cross-sectional shape includes an outer surface of the outer housing. One point on the outer surface is spaced apart from the axis by a first distance and a second point on the outer surface is spaced apart from the axis by a second distance different than the first distance.

The outer housings may be manufactured by die casting or other suitable processes May contain a provision for a leg extension release button that is generally flush with the surface of the housing rather than a leg extension that protrudes above the outermost surface of the outer housing "leg extension"

Fits at least partially inside the "outer housing" with a portion protruding below the lowermost surface of the outer housing Is acted against by compression springs that act to extend the leg extensions beyond the bottom-most surface of the outer housing In one embodiment, the leg extension Has non-parallel surfaces along its length Has annular grooves to facilitate control by the Leg Extension Control mechanism May have grooves along the length of the leg extension that are designed to reduce weight and increase stiffness May have non-symmetrical sections A non-symmetrical top protrusion designed to keep the leg extension from exiting the upper housing; and/or A non-symmetrical bottom protrusion designed to facilitate locating and indexing a bipod foot "Leg Extension Control"

A sliding mechanism that engages a geometry or geometries on the leg extension; the mechanism allows the extension to be extended from the bottom-most surface of the outer housing and then be held in place at established lengths The sliding mechanism contains a provision whereby the leg extension can be extended one notch at a time by moving the sliding mechanism one distance and allows the leg extension to be fully extended by moving the sliding mechanism beyond the first distance and to a second distance A "foot" on the bottom of each leg The foot can be removably attached to and simultaneously located in position on the leg extension of each bipod leg, The foot may be attached and located with a quick connect mechanism, such as a removable pin that is held in a detent notch in the foot and in a detent notch in the leg extension by spring pressure. Bringing force against the pin overcomes the spring pressure and moves the pin out of its home detent, thereby allowing the foot to be removed with a sharp point (e.g. the point of a bullet) rather than a specialized tool (e.g. a screwdriver); or A foot that is removably attached to the leg extension and is indicated in place with a fastener (the fastener could be a roll pin, a screw, or other fastener) that transverses one axis of the foot as well as one axis of the cant round, thereby attaching the foot to the leg extension and indicating it in position Several embodiments are expected to have one or more of the following features:

allow the user to adjust "pivot" and "cant", which increases the usefulness in the field;

may not require the use of specialized tools that are not readily available in the field;

can independently adjust "pivot" and "cant"

stock attachment methods that provide a robust system leg geometries may be manufactured by low-cost manufacturing methods legs with special geometries having lighter weight and greater strength than can be achieved with extruded legs Use feet that are removably attached to the legs of the bipod, which provides interchangeability;

can be attached without specialized tools are not readily available in the field

D. Conclusion

The bipod assembly disclosed herein provides adjustment mechanisms that could be used on a bipod that is attached directly to member on the firearm stock and does not require a mounting block. The bipod assembly further provides a bipod that allows tension-adjustable movement around two axes. For example, the bipod assembly can be tension-adjusted with a first cam lock for cant movement and can be tension adjusted with a second cam lock for pivotal movement.

The bipod assembly disclosed herein further provides removable, interchangeable feet which provide many advantages over bipods with fixed foot configurations. Hunters and tactical rifle users face much different usage situations and require different foot configurations. A hunter could want a light, small foot for hunting in rugged terrain. A tactical rifle operator might prefer a large, hard foot that slides easily along windowsills or ledges, or a snowshoe-shaped foot for use in sand or other soft surfaces—such a foot might be indicated for location on the lower leg for consistency of shot placement and use. The base mission of the bipod remains the same in all three cases, but the ability to interchange feet makes mission-specificity possible. Previously existing inventions have used feet that are manufactured integral to another part during the manufacturing process, feet permanently attached (e.g. welded) to a lower leg during manufacturing, or feet that are releasably mounted to the lower leg of the bipod Further advantages of independently tension-adjustable and lockable pivot and cam adjustments are provided by the bipod assembly disclosed herein. Rotation around two axes is critical for a bipod. The ability of the legs to rotate around the y axis gives the bipod the ability to accommodate uneven terrain under the bipod. A user can use adjustment around the y axis so that a plane bisecting the horizontal axis of the rifle bore is parallel to the horizon. Once that plane is level to the horizon, the bipod can be made to rotate around the z axis, allowing a user to "sweep" an area under watch. If the mechanisms that allow rotation around each axis are made tension-adjustable and lockable, users can select the amount of tension that must be overcome to change position around a single axis. In this use mode, a user could, for example, lightly tension both rotational axes in order to provide significant freedom of movement but some tension-assisted stability during the firing process. Previous inventions have allowed for controlled adjustment in a single dimension (Harris U.S. Pat. No. 4,903,525) or uncontrolled adjustment in multiple dimensions (Current model Caldwell bipods, Kramer U.S. Pat. No. 5,194,678) but no previously described bipod allows individual, controlled adjustment in each of single dimension independent of other dimensions.

According to alternative embodiments, the bipod disclosed herein does not include a vertical adjustment mechanism. This provides a simpler device having fewer moving parts. Further, small changes in vertical position are easy to get from the shooter's position and can be difficult to get mechanically, especially in combination with other mechanical mechanisms. Vertical position changes are also the least important adjustment to be able to make on a fast basis, as gravity insures that targets move left to right far more frequently than they do up and down. Shooters can relatively easily move up or down a small distance at their shoulder, which translates to a large amount of certical impact change at a downrange impact point.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, are incorporated herein by reference, in their entirety. Aspects of the invention can be modified, if necessary, to employ systems, circuits and concepts of the various patents, applications and publications to provide yet further embodiments of the invention.

One skilled in the art will appreciate that different manufacturing processes may provide variations of aspects of the embodiments described above. For example, the bipod may be manufactured from different materials and in different processes.

From the foregoing, it will be appreciated that specific embodiments of the invention have been described herein for purposes of illustration, but that various modifications may be made without deviating from the invention. Furthermore, aspects of the invention described in the context of particular embodiments may be combined or eliminated in other embodiments. Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited, except as by the appended claims.

We claim:

1. A bipod assembly for use with a firearm comprising:

an attachment assembly engageable with a swivel stud of a firearm; and an adjustment assembly coupled to the attachment assembly, the adjustment assembly including a cant bushing extending at least partially through a pivot bushing, the cant bushing having a first portion with a first longitudinal axis configured to be generally parallel to the firearm longitudinal axis, and a second portion extending away from the first portion in a direction generally perpendicular to the first longitudinal axis, and wherein the cant bushing allows movement of the bipod assembly about a first axis and the pivot bushing allows movement of the bipod assembly about a second axis.

2. The assembly of claim 1 wherein the attachment assembly includes a first portion and a second portion, the first portion has a protrusion and the second portion has a opposed protrusion, wherein the protrusions are configured to releasably retain the sling swivel on the stock of the firearm.

3. The assembly of claim 1 wherein the attachment assembly includes a threaded shaft configured to receive a locking washer thereon.

4. The assembly of claim 1 wherein the adjustment assembly further includes a first locking cam to stop movement about the first axis.

5. The assembly of claim 4 wherein the adjustment assembly further includes a second locking cam to stop movement about the second axis.

6. The assembly of claim 1 further comprising a stock mount bracket for reciprocally mating adjacent the stock of the firearm.

7. The assembly of claim 6 wherein the stock mount bracket further includes an aperture for receiving the attachment assembly.

8. The assembly of claim 1 further comprising a pair of legs coupled to the adjustment assembly.

9. The assembly of claim 8 wherein the pivot bushing further includes sleeves removeably coupled to protrusions, wherein the sleeves releasably retain the leg extensions.

10. The assembly of claim 9 further comprising a pair of feet coupled to distal ends of leg extensions, wherein the feet are removeably coupled to the leg extensions.

11. The assembly of claim 10 wherein the feet are removable from the leg extensions without a tool.

12. The assembly of claim 11 wherein the sleeves further include a compression spring outwardly biasing the leg extensions to an open position.

13. The assembly of claim 1 wherein the first portion of the cant bushing includes a generally tubular body having an aperture extending therethrough configured to receive a pivot pin that is pivotally coupled to the stock mount bracket.

14. The assembly of claim 13 wherein the second portion of the cant bushing has a generally cylindrical shape.

15. The assembly of claim 13 wherein the cant bushing further comprises a first protrusion opposite a second protrusion, the first and second protrusions extending away from an exterior surface of the tubular body, wherein the first and second protrusions are configured to contact the stock mount bracket to at least partially limit the rotation of the stock mount bracket with reference to the cant bushing.

16. The assembly of claim 1 wherein the pivot bushing includes a stop member partially extending into the opening, and wherein the second portion of the cant bushing includes a notched portion configured to contact the stop member to at least partially limit the rotation of the cant bushing with reference to the pivot bushing.

17. The assembly of claim 1 wherein the adjustment assembly further comprises a first locking cam configured to restrict rotation of the stock mount bracket about the cant bushing.

18. The assembly of claim 1 wherein the adjustment assembly further comprises a second locking cam configured to restrict rotation of the cant bushing with reference to the pivot bushing.

* * * * *